US006095503A

United States Patent [19]

Burley et al.

[11] Patent Number: 6,095,503

[45] Date of Patent: Aug. 1, 2000

[54] DASHER BOARD SYSTEM

[75] Inventors: John S. Burley; Michael R. Moncilovich, both of Johnstown; John Charles Hicks, Jr., Barnesboro, all of Pa.

[73] Assignee: Burley's Rink Supply, Inc., Johnstown, Pa.

[21] Appl. No.: 09/038,290

[22] Filed: Mar. 11, 1998

[51] Int. Cl.[7] ..... E04H 17/16

[52] U.S. Cl. ..... 256/24; 256/25; 256/73; 256/31; 472/94

[58] Field of Search ..... 472/94, 92; 256/24, 256/25, 26, 30, 31, 73; 52/245, 247, 582.1, 766

[56] References Cited

U.S. PATENT DOCUMENTS

| | | | |
|---|---|---|---|
| 3,551,920 | 1/1971 | Greene | 256/26 X |
| 3,691,004 | 9/1972 | Werner et al. . | |
| 3,709,489 | 1/1973 | Holleran et al. | 472/94 |
| 3,727,888 | 4/1973 | Nickolas . | |
| 3,844,539 | 10/1974 | Abbott . | |
| 3,883,120 | 5/1975 | Tippmann . | |
| 3,986,342 | 10/1976 | MacCracken . | |
| 4,078,795 | 3/1978 | Porter | 256/24 |
| 4,392,647 | 7/1983 | Golebieski . | |
| 4,497,483 | 2/1985 | Ahlgren . | |
| 4,883,267 | 11/1989 | Burley . | |
| 4,905,970 | 3/1990 | Holmsten et al. | 472/94 X |
| 5,286,320 | 2/1994 | McGrath et al. . | |
| 5,700,417 | 12/1997 | Fernyhough et al. . | |
| 5,706,625 | 1/1998 | Vallance et al. | 472/94 X |
| 5,709,099 | 1/1998 | Blades et al. . | |
| 5,863,030 | 1/1999 | Kotler et al. | 472/94 X |
| 5,899,171 | 5/1999 | Abrahamson | 256/31 X |

FOREIGN PATENT DOCUMENTS

| | | | |
|---|---|---|---|
| 2248786 | 5/1975 | France | 256/26 |
| 2 669 834 | 6/1992 | France . | |
| 645 275 | 9/1984 | Switzerland . | |

OTHER PUBLICATIONS

Holmsten Ice Rinks, Inc., Holmsten Rinkmaster, "*Dasher Board Systems Buyers Guide*," 1990.

*Primary Examiner*—Lynne H. Browne
*Assistant Examiner*—David E. Bochna
*Attorney, Agent, or Firm*—Banner & Witcoff, Ltd.

[57] ABSTRACT

A dasher board system for providing a surrounding barrier for the playing surface of a hockey rink. The dasher board system includes lower dasher board sections and extended continuous transparent upper shielding elements. The lower dasher board sections are formed by pultrusion. This gives the dasher board sections a high concentration of fiberglass and a high strength-to-weight ratio. This enables the sections to be made in longer lengths and reduces assembly time. The dasher board sections include horizontal ribs formed therein during the pultrusion process. A mounting system includes supports that are mounted to the horizontal ribs to stabilize the dasher board sections. Curved dasher board sections are formed by cutting the horizontal ribs and flexing the dasher board sections in the regions of the cuts. The transparent upper shielding is formed from by unrolling an elongated length of relatively thin polycarbonate material. The shielding is coupled to wires that extend between the supports, or to the supports themselves. The wires are pulled to tension the shielding and form the upper barrier. The dasher board system can be mounted to numerous different supporting structures, including but not limited to, fence posts, raised concrete curbs, flush concrete rings, and through asphalt surfaces. Alternatively, the dasher board system can be stabilized by supports that are not fixedly mounted to a support surface to permit the dasher board system to be easily assembled and disassembled without affecting the support surface. In one arrangement, the supports can be folded into the dasher board sections to facilitate storage of the system.

49 Claims, 17 Drawing Sheets

DASHER BOARD SYSTEM

TECHNICAL FIELD

This invention relates to a dasher board system for providing a surrounding barrier for the playing surface of a rink, e.g., a hockey rink. More particularly, this invention relates to a dasher board system made up of frameless lower sections and an extended continuous upper shielding element.

BACKGROUND OF THE INVENTION

Dasher board systems are used for providing an outer wall surface for a hockey rink and they typically include lower dasher board sections and an upper shielding arrangement attached to certain dasher board sections. Numerous types of dasher board sections are known in the prior art. These prior art dasher board sections can basically be classified into two groups: framed and molded. Framed dasher board sections are typically comprised of steel, aluminum, or wooden supports that are welded, bolted, nailed, or attached otherwise to form a frame. A facing panel, typically made of a single sheet of plywood or polyethylene, or a multi-layered arrangement of plywood and polyethylene sheets, is attached by screw fasteners to the side of the frame that faces the playing surface of the rink. A kick-plate is fastened to a lower portion of the facing panel to provide necessary support and reinforcement where pucks and skates are most likely to contact the dasher boards. Additionally, a back sheet is sometimes attached to the frame. While some of these "framed" dasher boards have provided a suitable surrounding boundary around rink surfaces at some locations, they have had drawbacks. The framed dasher board sections are labor intensive to assemble, requiring the assembly of a frame and secondary attachment of a plurality of sheets to the frame. This significantly increases the cost of the dasher board system. Additionally, over time, maintenance and replacement costs can escalate, as fasteners loosen, wooden elements warp and rot, and facing panels chip and splinter. Further, because the dasher board sections are made from many different attached elements, tolerancing problems between adjacent dasher board sections are more likely to occur.

The second group of dasher boards, i.e., the molded dasher board sections, are made from fiberglass with a binding resinous material, e.g., polyester. U.S. Pat. No. 3,844,539 to Abbott and U.S. Pat. No. 3,883,120 to Tippmann show two designs within this second group. However, as these dasher board sections are molded, they require a separate mold for each distinct board section. Thus, these designs may be costly as board sections have varying lengths and varying radii of curvature. Moreover, the general cost of manufacturing of these designs is expensive. Board systems similar to the design disclosed in U.S. Pat. No. 3,883,120 to Tippmann can cost approximately $100,000–$125,000 assembled, including upper shielding. Further, in the molding process, the fiberglass is packed into the mold manually. Most likely, this method would achieve only a 30% ratio of glass-to-resin. This places an inherent limit on the strength-to-weight ratio of these dasher board sections and contributes to their high cost and high weight per length. For example, a 42 inch high, 8 foot dasher board section of this design typically weighs approximately 260 lbs.

Therefore, a dasher board system was thus needed which would overcome the assembly, maintenance, and replacement problems of the framed dasher board systems, and which would also overcome the manufacturing costs associated with the molded dasher board systems. The present invention was developed to accomplish this objective.

Additionally, prior art dasher board systems typically include some upper shielding structure above portions of the lower dasher board sections to (1) keep the playing projectile in the playing area, thus protecting any spectators and permitting play of the game to continue, and (2) protect the players and spectators when the players hit the dasher boards during the normal course of play. Currently, most upper shielding systems are made of chain link fences or individual thick transparent panels. Chain link shielding is frequently used in outdoor applications. Chain link shielding is formed by supporting metal fencing by spaced metal posts However, chain link shielding, has drawbacks in that there is poor visibility through the shielding and that there are significant safety concerns with the fencing and its supporting posts.

Transparent shielding has typically been comprised of 0.5 to 0.625 inch thick glass, acrylic, or polycarbonate transparent panels placed between metal frames. These panels usually come in 4 foot length sections. Metal-framed transparent panel systems have their drawbacks as well. For example, some of the panels have been known to shatter. Additionally, the metal-framed transparent panels are expensive and are labor intensive to assemble. Moreover, individual panels can fall out of their frames and injury people in the vicinity.

Another transparent shielding design has used transparent panels without continuous vertical frame members. According to this design, the panel sections are coupled to each other adjacent their upper ends by fastening devices. This design is commonly referred to as "seamless", although seams are present between adjacent panels. In this design, the panels have been made thicker, e.g., 0.75 to 1.00 inches, to be more resistant to shattering. However, these thicker panels have little or no flexibility and can cause injury to a player that has been checked into the shielding.

Therefore, a dasher board system with an upper shielding arrangement was thus needed that would overcome the drawbacks of existing upper shielding arrangements. The present invention was developed to accomplish this additional objective.

SUMMARY OF THE INVENTION

The invention relates to a dasher board system having improved dasher board sections, improved upper shielding, and an improved mounting system for the dasher board sections and the upper shielding.

It is an object of the present invention to provide and make dasher boards sections for a dasher board system that have an exceptionally high fiberglass content and an exceptionally high strength-to-weight ratio.

It is an object of the present invention to provide and make dasher boards sections for a dasher board system that are formed by a pultrusion process that enables straight and curved, and long and short sections to be made from the same die.

Another object of the present invention to provide and make dasher boards sections for a dasher board system that includes significant cost savings over the prior art molded designs.

It is another object of the present invention to provide a dasher board system with supporting arrangements that optimize mounting conditions based upon the desired rink surface, e.g., ice, floor, or pavement, and the desired method of mounting, e.g., permanent of temporary.

It is yet another object of the present invention provide and upper shielding for a dasher board system that includes a frameless sheet of transparent material that can be unrolled and curved to match the contour of the dasher board sections.

It is another object of the present invention to facilitate the assembly of the dasher board sections and the upper shielding of a dasher board system.

It is an object of the present invention to provide a dasher board system, for a boundary of a hockey surface, having first and second dasher board sections positioned adjacent each other in an end-to-end relationship. At least the first dasher board section includes a top, a bottom, a length, and a horizontally extending strengthening rib located between and spaced from the top and bottom of the first dasher board section. The horizontally extending strengthening rib extends substantially the entire length of the first dasher board section, and/or includes portions thereof that have been removed at a plurality of spaced locations along its length. Additionally or alternatively, the dasher boards sections are at least 10% fiberglass by volume and are in excess of fifteen feet in length.

It is another object of the present invention to provide a method for making a dasher board system for a rink whereby a plurality of dasher board sections are formed by the process of pultrusion. The plurality of dasher board sections are placed in an end-to-end relationship. The dasher board sections are supported and stabilized in their end-to-end relationship.

It is yet another object of the present invention to provide a method for making a dasher board system for a rink whereby first and second dasher board sections are formed having horizontal ribs. The horizontal ribs of at least the second dasher board section are transversely cut. The second dasher board section is bent to achieve a predetermined curvature. The first and second dasher board sections are placed in an end-to-end relationship and fixed to restrain movement thereof It is an object of the present invention to provide a dasher board system, for a boundary of a hockey surface, having a plurality of dasher board sections that form a lower peripheral wall around the hockey surface. Transparent upper shielding extends along and above at least three of the dasher board sections to provide an upper peripheral wall around the hockey surface. The transparent upper shielding is a single frameless piece of material in at least the region above the three dasher board sections.

It is an additional object of the present invention to provide a dasher board system, for a boundary of a hockey surface, having a plurality of dasher board sections that form a lower peripheral wall around the hockey surface. The dasher board system also includes supports, a wire, and transparent upper shielding. The supports are spaced around the peripheral wall on the outside of the dasher board sections, and are attached to the dasher board sections to restrain movement thereof. The wire extends between a plurality of the supports. The transparent upper shielding extends along and above the dasher board sections and is coupled to the wire.

It is an object of the present invention to provide a method for making a dasher board system for a rink whereby first and second dasher board sections are formed, and rolled transparent shielding material is provided. Supports are attached to a base support structure. The transparent shielding material is unrolled and attached to the supports. The first and second dasher board sections are placed in an end-to-end relationship and attached to the supports.

Additionally, it is another object of the present invention to provide a dasher board system, for a boundary of a hockey surface, having first and second dasher board sections positioned adjacent each other in an end-to-end relationship. At least the first dasher board section includes a top, a bottom, a length, and a horizontally extending strengthening rib located between and spaced from the top and bottom of the first dasher board section. A support assembly is pivotally coupled to the strengthening rib of the first dasher board section for movement between a storage position and an in-use position. The support assembly supports the first dasher board section when in the in-use position. The support assembly is pivotally movable with respect to the first dasher board section about a horizontal axis and about a vertical axis.

It is a further object of the present invention to provide a dasher board system, mounted upon an existing asphalt surface, having first and second dasher board sections positioned adjacent each other in an end-to-end relationship. Each of a plurality of structural supports are attached to a dasher board section. Each of a plurality of earth anchors extend through the asphalt surface and into the ground below the asphalt surface.

Further objects, features and other aspects of this invention will be understood from the following detailed description of the preferred embodiments of this invention with reference to the attached drawing figures.

DESCRIPTION OF THE PREFERRED EMBODIMENTS

Figure 1:
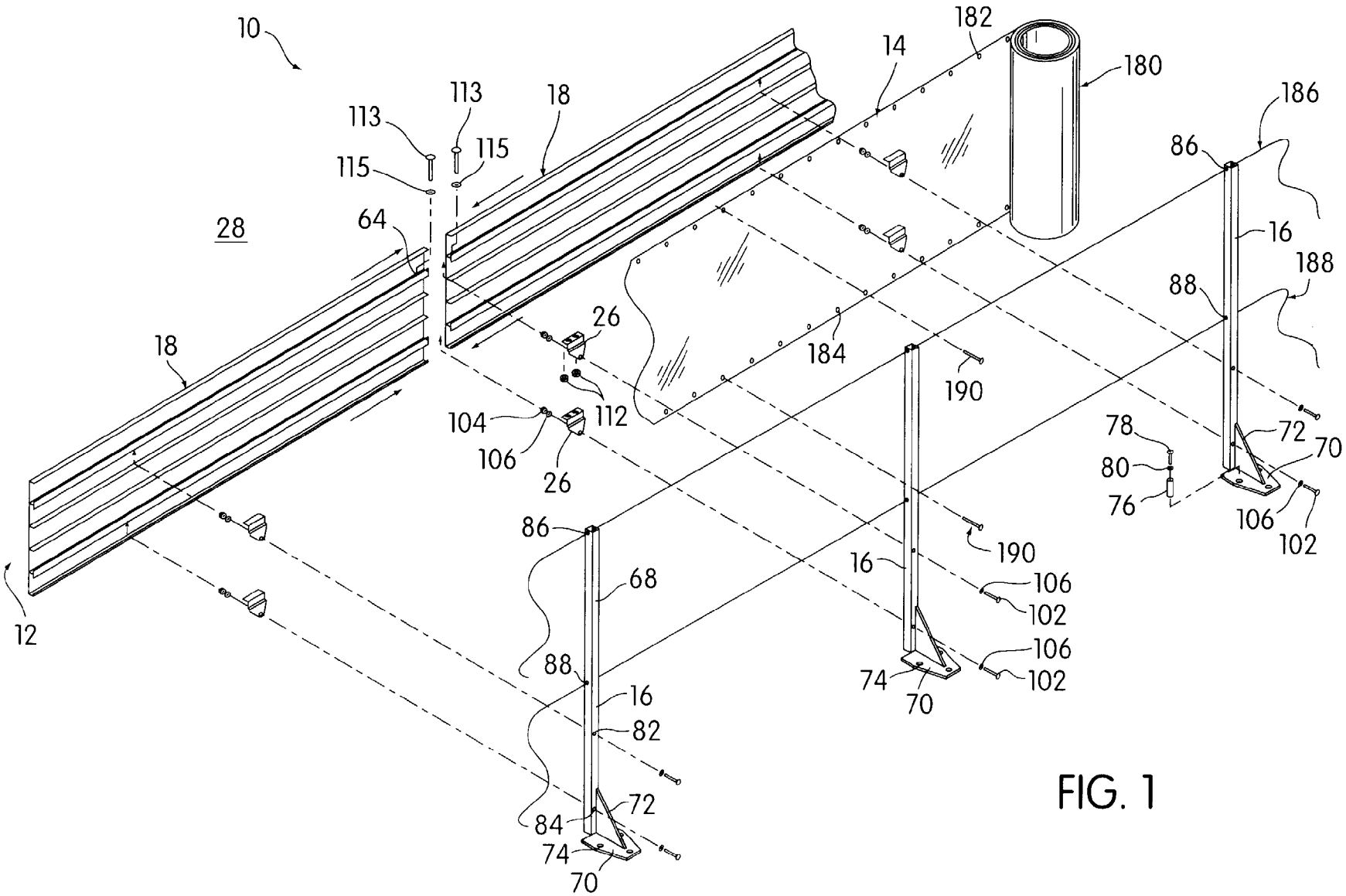
FIG. 1 is a perspective assembly view of the dasher board system showing the relationship between the dasher board sections, the upper shielding, and the mounting system.

Referring to the drawings wherein like numerals indicate like elements, a dasher board system, designated generally by reference numeral 10, is illustrated. Dasher board system 10 surrounds a rink surface 28, e.g., an ice, street, or floor hockey rink 21, and provides a structural boundary for maintaining the playing projectile in the playing area. In addition, dasher board system 10 is sufficiently strong to withstand high forces when players are checked into the "boards", while being relatively flexible to minimize injuries when this occurs.

Figure 2:
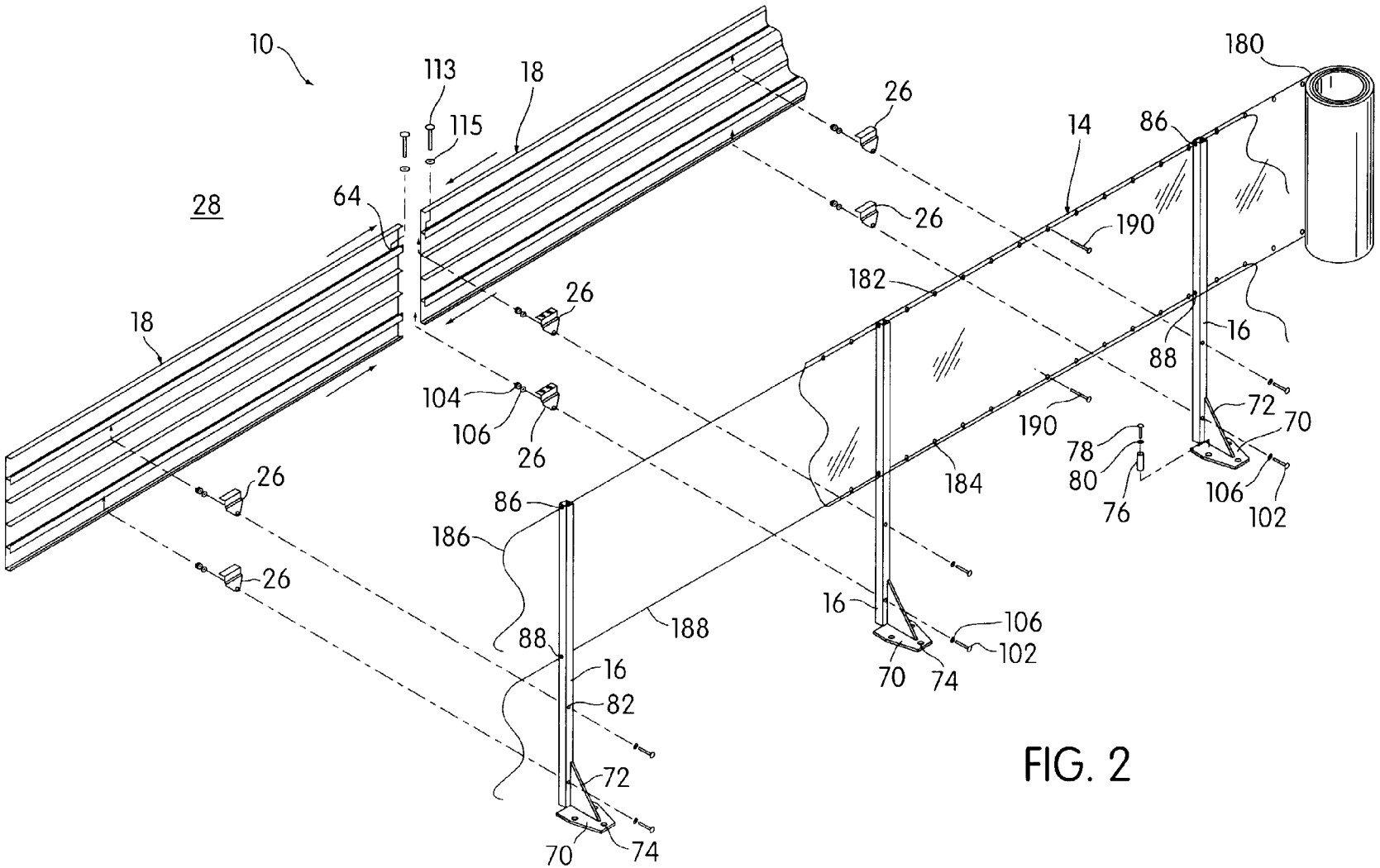
FIG. 2 is a perspective assembly view of the dasher board system similar to FIG. 1, showing the upper shielding attached to the supports.
Figure 3:
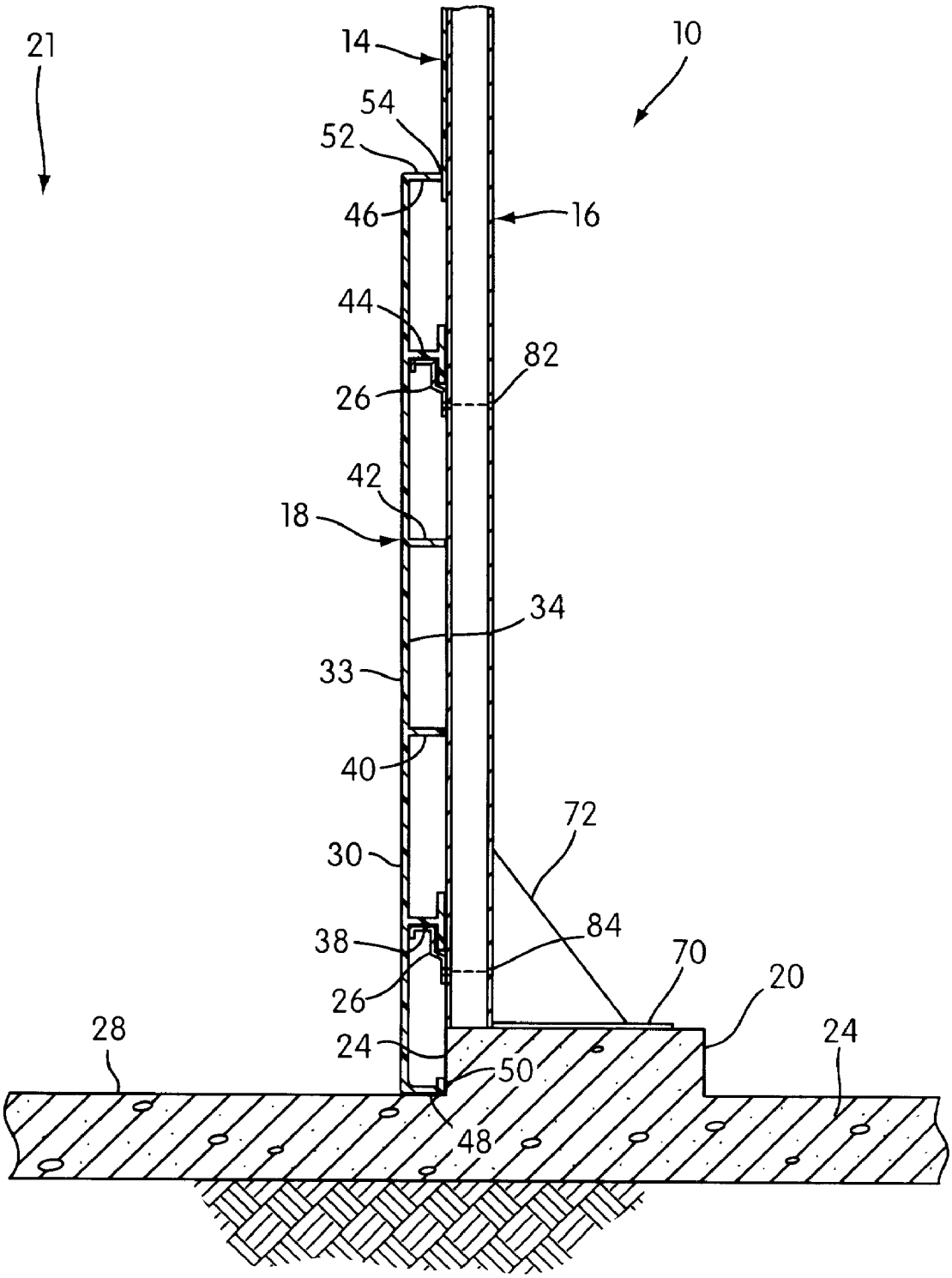
FIG. 3 is a side cross sectional view of an installed dasher board system taken through a vertical support.

As illustrated in FIGS. 1–3, dasher board system 10 generally includes lower dasher boards 12, upper shielding 14, and supports 16. The lower dasher boards 12 include a number of dasher board sections 18 arranged in an end-to-end configuration to define the outer limits or border of the playing surface. The supports 16 are positioned outside the perimeter region of the playing area and are spaced from one another by a suitable distance, e.g., 5 feet apart, to support the remainder of dasher board system 10. More specifically, supports 16 are used to stabilize the lower dasher board sections 12 and the upper shielding 14 with respect to the playing surface. For example, for a rink 21 having a raised perimeter curb 20, the supports 16 are preferably mounted to the top of the curb 20. The dasher board sections 18 are positioned with their back surface against the inside periphery 24 of the curb 20 and against the support 16. Mounting clips or brackets 26 are used to attach the dasher board sections 18 to each other and to the supports 16. The front of the dasher board sections 18 faces the rink surface 28 on which the game is played. The rink surface may be ice, paving, or a flooring surface. In a preferred embodiment, one or more sheets of transparent upper shielding 14 is positioned with its back surface against the supports 16 above the dasher board sections 18.

Figure 4:
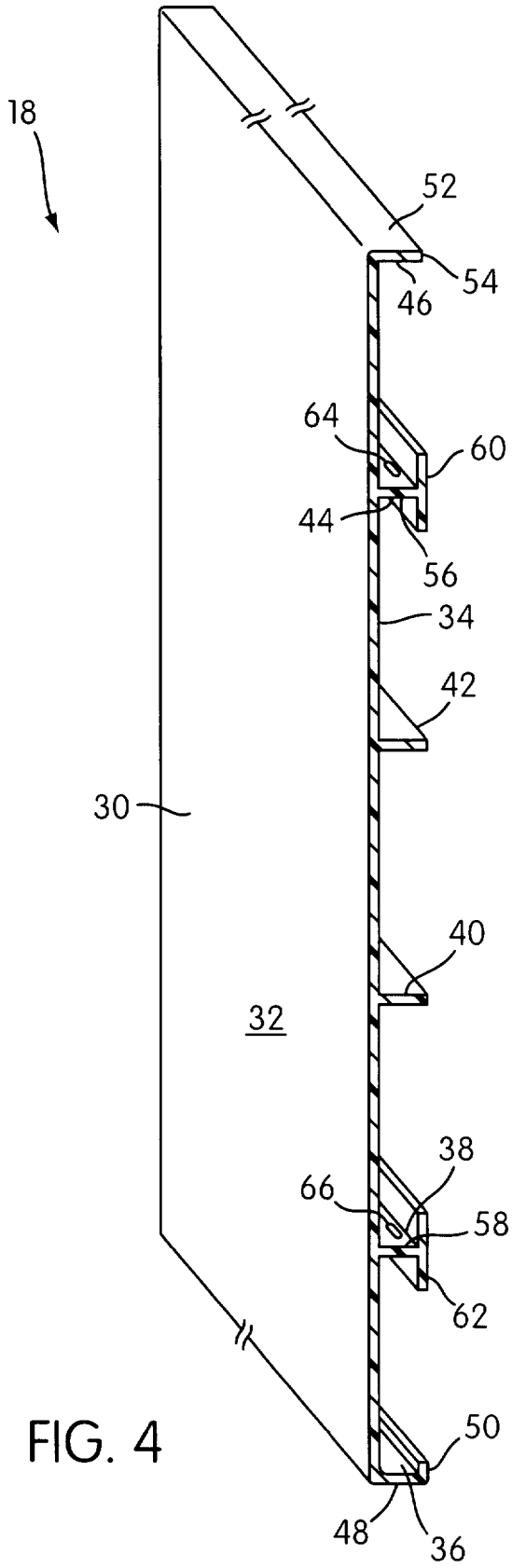
FIG. 4 is an isometric view of a dasher board section.
Figure 5:
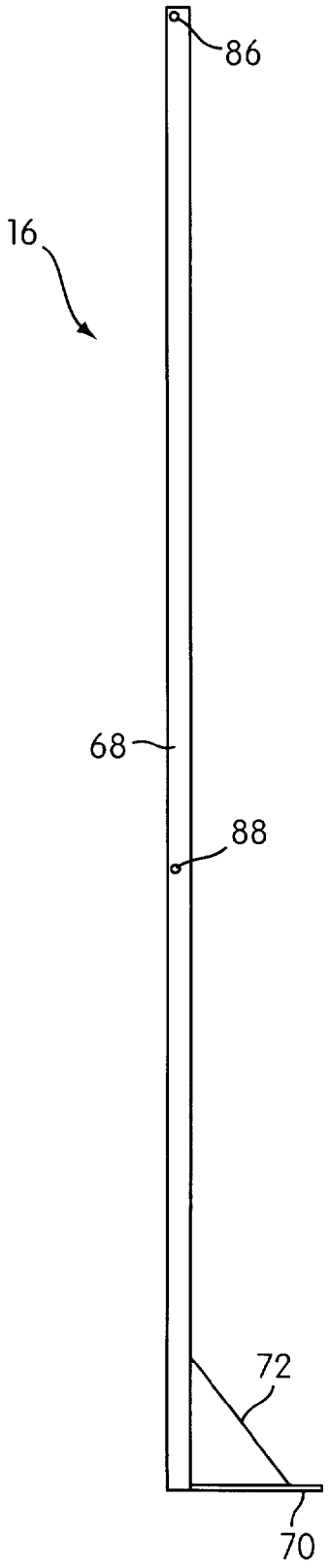
FIGS. 5 and 6 are side elevational and rear elevational views of the support.
Figure 6:
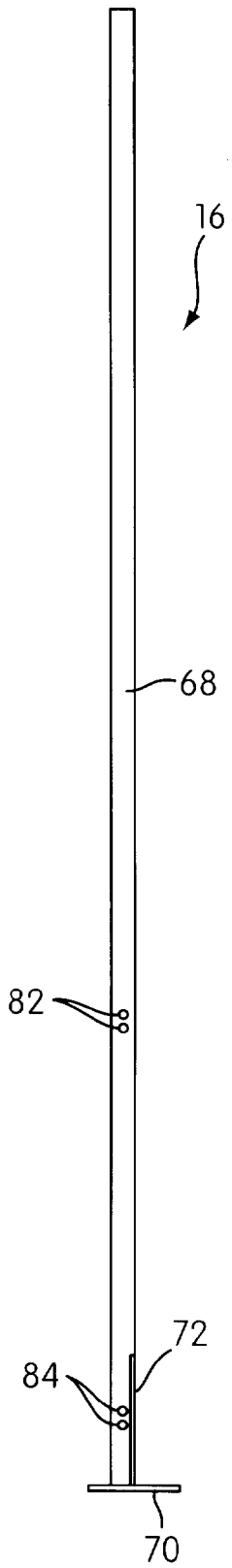

A cross section of a dasher board section 18 is shown in FIG. 4. Each section 18 includes a wall portion 30 having a front side 32 that faces the playing surface 28 and a rear side 34 facing away from the playing surface 28. Each dasher board section 18 also includes a number of strengthening ribs 36, 38, 40, 42, 44, and 46 that extend rearwardly, i.e., away from the playing surface, from the rear side 34 of wall portion 30, to strengthen and reinforce the dasher board section 18 and to provide the desired stiffness to the section 18.

The bottom strengthening rib 36 includes a horizontal flange 48 and a vertical flange 50, and assists in the alignment of the dasher board section 18 with respect to the rink surface 28, and raised perimeter curb 22, if available, in addition to providing strength and stiffness to dasher board section 18. A sealant or sealing member, may be positioned at the base of horizontal flange 48 to seal the region between the bottom of the dasher board section 18 and the rink surface 28.

The center strengthening ribs 40 and 42 and top strengthening rib 46 also provide the desired strength and rigidity to the board section 18. In addition to providing strength and stiffness, top strengthening rib 46 also has a horizontal top surface 52 that forms a small ledge within the playing area at the top of the dasher board section 18. Top strengthening rib 46 further includes a rear edge 54 that can be used to clamp the upper shielding 14 to the support 16.

T-shaped strengthening ribs 38 and 44 are positioned above and below the center strengthening ribs 40 and 42. These ribs 44 and 38 help mount the board section 18 to the support 16 and add additional strength and rigidity to its respective section 18. Upper and lower T-shaped strengthening ribs 38 and 44 include a horizontal flange 56 and 58 and a vertical flange 60 and 62, respectively. Adjacent the ends of the dasher board sections 18, the horizontal flanges 56 and 58 have respective vertical through holes 64 and 66 enabling the mounting clip 26 to be fixedly attached to the ends of the dasher board sections 18. This prevents any undesirable separation between adjacent dasher board sections 18. Details of the composition and manufacturing of dasher board sections 18 as well as additional details of the mounting arrangement thereof are described hereinafter.

As shown in FIGS. 1–3, 5 and 6, each support 16 includes a tubular vertical post 68, a horizontal baseplate 70, and a support gusset 72. The horizontal baseplate 70 is placed on a level base supporting surface 29 adjacent the outer perimeter of the rink surface, for example on a raised perimeter curb 20. Holes 74 in horizontal baseplate 70 permit the support 16 to be mounted to the base supporting surface 29 by suitable mounting hardware. One preferred mounting hardware arrangement includes high tensile concrete expansion anchors 76 positioned in holes in the base supporting surface 29 that are in a pattern and spacing corresponding to the pattern and spacing of the holes 74 in the baseplate 70. Bolts 78 and washers 80 may then be used in a conventional manner so that the bolts 78 extend through respective holes 74 in baseplate 70 and into respective anchors 76 for affixing the supports 16 to the base supporting surface 29. A vertically oriented support gusset 72 is suitably attached, for example by welding, to a respective vertical post 68 and baseplate 70 to provide a rigid and sturdy connection therebetween.

Vertical post 68 also includes upper and lower pairs of holes 82 and 84 perpendicular to the length of the attached dasher board section 18, and upper and lower holes 86 and 88 parallel to the length of the attached dasher board section 18. The perpendicular hole pairs 82 and 84 permit attachment of the mounting clips 26 thereto. The parallel holes 86 and 88 permit the passage of respective wires for coupling upper shielding 14 thereto. To facilitate access to the holes 84, it is preferred that the gussets 72 be horizontally offset The supports 16 vary in height depending upon the desired height and existence of upper shielding 14 at each point along the perimeter of the dasher board system 10. For example, it may be desirable to have (1) a first and maximum shielding height used in the region immediately surrounding the opposing ends of the rink, i.e., where the nets are typically positioned, (2) a second shielding height used on the sides of the rink between the opposing ends, and (3) no upper shielding used on side portions in the vicinity of the team benches. Thus, according to this example, the supports 16 in the vicinity of the team benches would terminate at the approximate position where the top strengthening rib 46 of the dasher board section 18 would abut those supports 16. Additionally, these particular supports 16 would not include holes 86 and 88 for coupling upper shielding 14 thereto. Supports 16 in the regions of upper shielding 14 extend above the top of their respective dasher board section 18 by an amount generally corresponding to the approximate height of the upper shielding 14 in that area.

The mounting clips 26 are shown in FIGS. 1–3 and 7–9. Each mounting clip 26 primarily includes a first lower vertical portion 90, a second upper vertical portion 92, and a horizontal portion 94. An angular offset portion 96 provides a slight offset displacement between the lower and upper vertical portions 90 and 92 that generally corresponds to the thickness of vertical flanges 60 and 62 of the T-shaped strengthening ribs 38 and 44. Optionally, a downwardly extending lip 98 may be provided at the forward edge of horizontal portion 94. As best shown in FIG. 3, the shape of the mounting clip 26 corresponds to the contours of the region on the underside of the T-shaped strengthening ribs 38 and 44, respectively. For example, the rear surface of lower vertical portion 90 is positioned against the front face of the support 16. The rear surface of upper vertical portion 92 is positioned against the forward facing surface of the vertical flanges 60 and 62 of the T-shaped strengthening ribs 38 and 44. The horizontal portion 94 is positioned against the bottom surface of the horizontal flanges 56 and 58 of the T-shaped strengthening ribs 38 and 44. Additionally, downwardly extending lip 98 is positioned against the rear side 34 of the wall portion 30 of the dasher board section 18.

Each mounting clip 26 is attached to the vertical post 68 of a respective support 16 by conventional hardware. For example, in a preferred embodiment, the lower vertical portion 90 of the mounting clips 26 include a vertically slotted hole 100. A bolt 102 may be inserted through a hole 82 or 84 in post 68 and through slotted hole 100 in clip 26, and fastened on the inner side of the mounting clip 26 by a lock nut 104. Washers 106 may also be used in a conventional manner. This arrangement permits the clips 26 to first be coupled to the support 16 and then raised up to the abut the inside region of the T-shaped strengthening ribs 38 and 44, prior to being tightened.

The supports 16 are positioned along the length of the dasher board sections 18 in addition to being placed at the junctions between adjacent dasher board sections 18 that have been placed end-to-end. The mounting clips 26 and supports 16 positioned along the length of the dasher board sections 18 need not be physically fixed to the dasher board sections 18. The tolerancing between the mounting clips 26 and the contours of the region on the underside of the T-shaped strengthening ribs 38 and 44 is sufficient to restrain any significant motion therebetween. Moreover, the small tolerancing in this region permits a small amount of desired flexibility between the dasher board section 18 and the support 16 to help minimize the possibility of injury to players who collides into a dasher board section 18 with a high impacting force. In addition, this tolerancing enhances the ability to align adjacent board sections 18 at their junctions.

Figure 8:
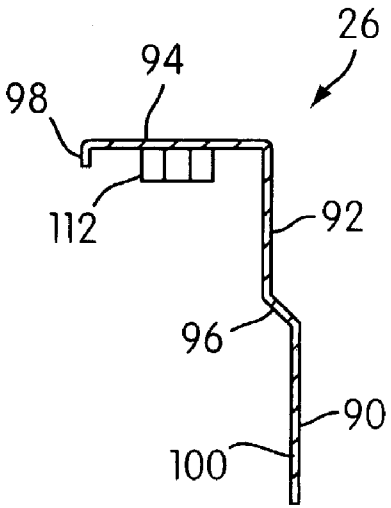
FIGS. 7–9 front elevational, side elevational, and top plan views of the mounting clip for attaching the dasher board section to each other and/or to the support.
Figure 9:
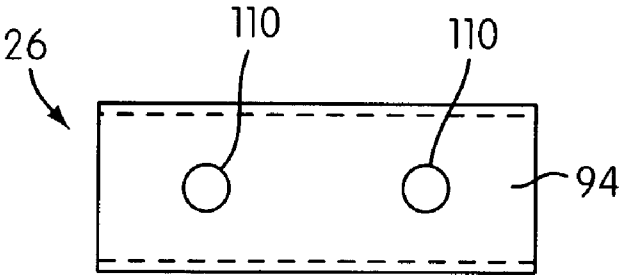
Figure 7:
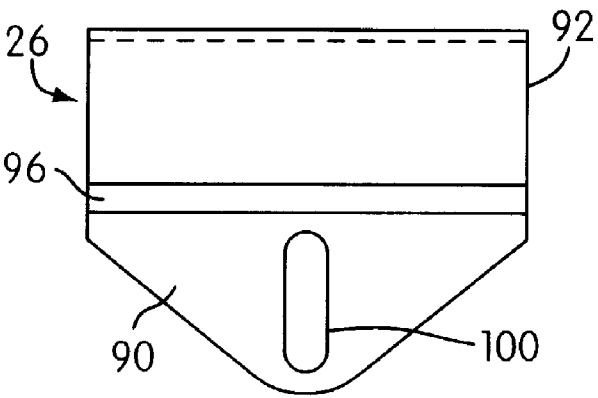
Figure 10:
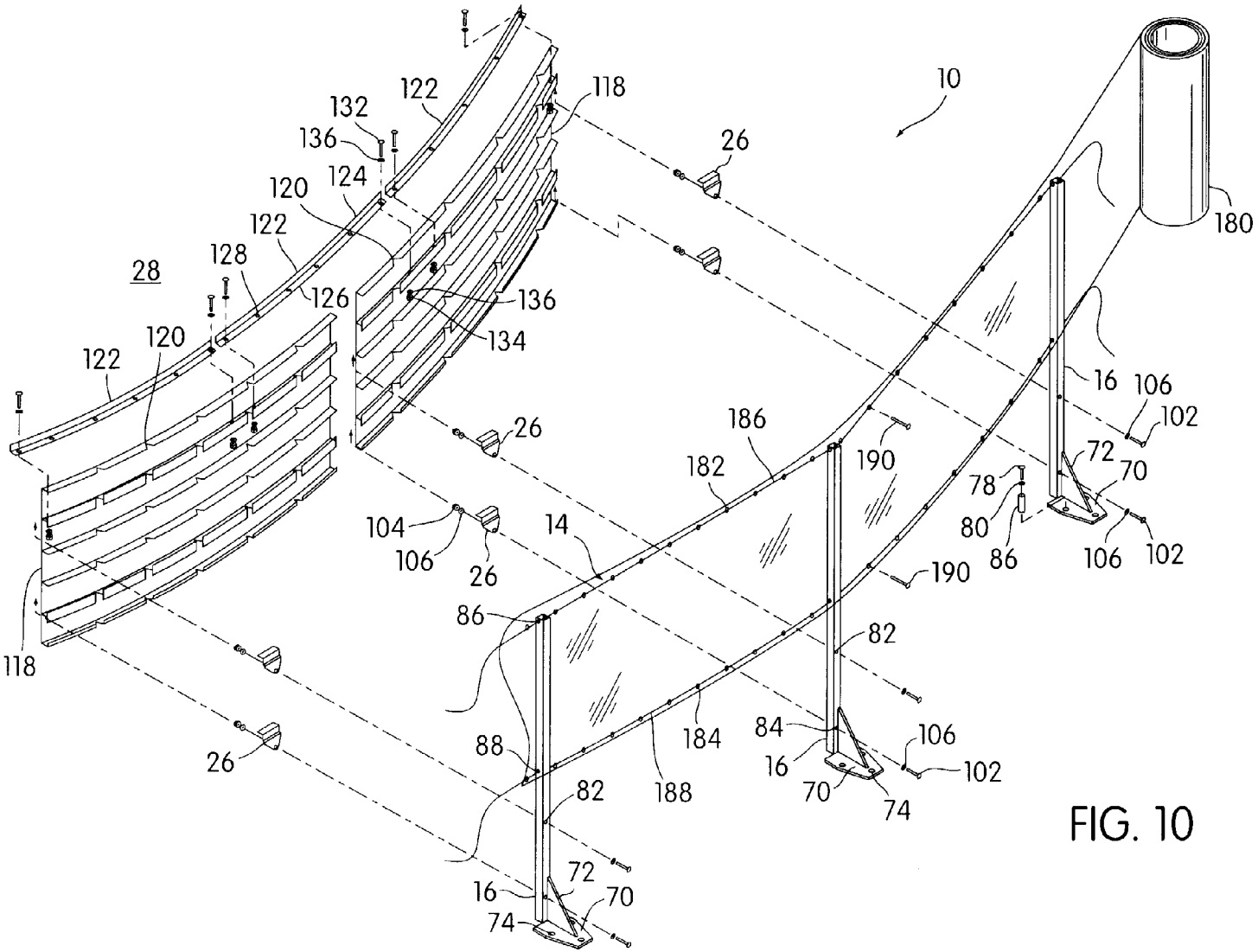
FIG. 10 is a perspective assembly view of the dasher board system similar to FIG. 2, showing the mounting of curved dasher board sections.

The mounting clips 26 that are used on supports 16 positioned at the dasher board junctions are affixed to the dasher boards sections 18 to ensure that the ends of the dasher board sections 18 abut each other and form and maintain a smooth continuous front facing wall surface. Accordingly, there is reduced flexibility and enhanced rigidity in this area. To accomplish this, the mounting clips 26 used in this region preferably include two mounting holes 110 in their horizontal portion 94 that are laterally spaced to correspond to the spacing between the holes 64 or 66 in the flanges 56 or 58 of adjacent dasher board sections 18 when placed in an abutting relationship. Conventional hardware, for example, lock nuts 112, bolts 113 and washers 115, may then be used to fixedly attach the mounting clips 26 to the dasher board sections 18 through the aligned holes 110 and 64 and 66. In one arrangement, the lock nuts 112 may be press fit into holes 110 as shown in FIG. 8. In another arrangement, not shown, upwardly extending bolts may be press fit into holes 110. In assembly, the bolts will extend through holes 64 and/or 66 in the flanges 56 and/or 58 and attached and tightened using on the upper side of the flanges 56 and/or 58 by a lock nut.

Normally, the playing surface will be curved in its corners and the desired curvature in these regions can vary greatly from design to design. Thus, to form the entire wall boundary for the playing area, the dasher boards system 10 also includes curved board sections 118. Curved board sections 118 are similar to the straight board with a few exceptions. Primarily, curved dasher board sections 118 differ from straight dasher board sections 18 by slits, notches, or gaps, generically referred to herein as cuts 120, that have been cut in strengthening ribs 36, 38, 40, 42, 44, 46, by a saw or other cutting device, and by the addition of curve defining and reinforcing members 122. As described below, the cuts 120 in the strengthening ribs significantly reduce the rigidity in those regions and permit the dasher board section 118 to bend and flex along those cut lines. It should be noted that the shape of the cut 120 is not critical and it may be a narrow linear band, a wider band, or a V-shaped cutout. In a preferred embodiment, the cut 120 creates a narrow linear void in the ribs as thin as possible, e.g., less than 0.125 inches.

Figure 11:
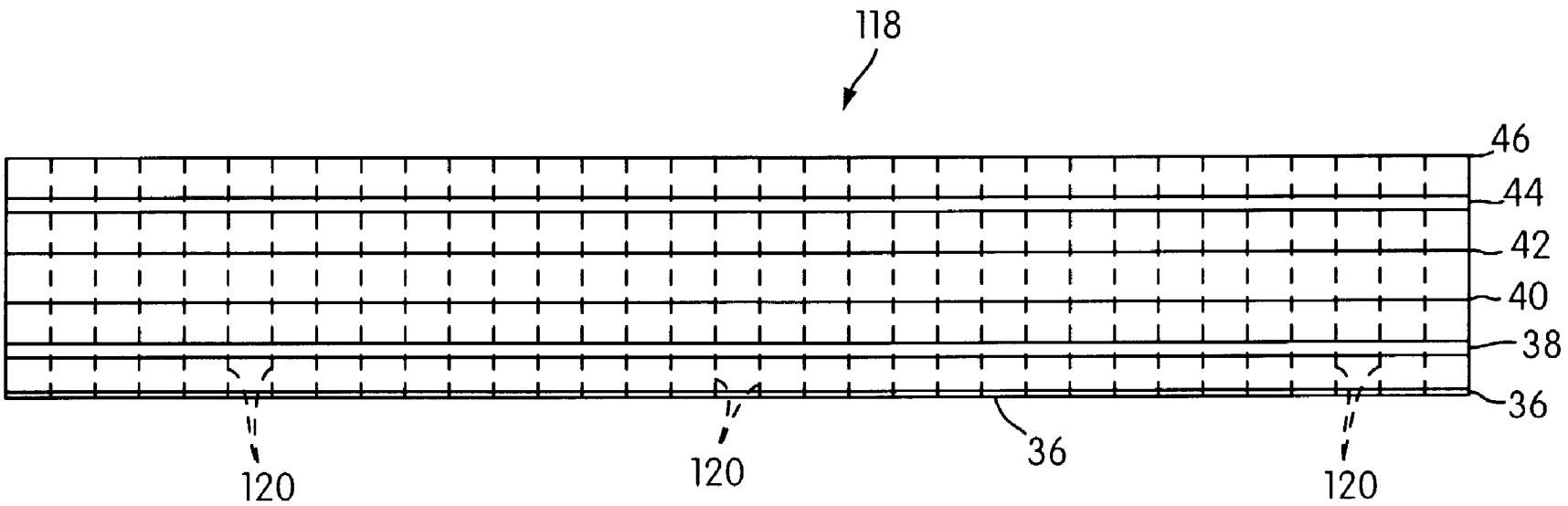
FIG. 11 is a rear elevational view of a curved dasher board section after ribs have been cut in it.

FIG. 11 shows one embodiment whereby an elongated dasher board section 118 is provided with a periodic transverse vertical cuts 120. For example, if dasher board section 118 is 20 feet in length, cuts 120 might preferrely be provided every 8 inches. This frequency of cuts 120 permits the curvature of the dasher board section 118 to be gradual in nature. The cuts 120 preferably extend substantially through the strengthening ribs 36, 38, 40, 42, 44, 46, but do not extend into the wall portion 30. However, it may be possible to obtain the necessary flexibility by not cutting substantially through the strengthening ribs. Once the cuts 120 are formed, each dasher board section 118 can be flexed to its desired radius to correspond to its curve defining and reinforcing members 122. It is preferred that all surfaces of the dasher board sections 118 that are exposed by the cuts 120 be sealed.

Curve defining and reinforcing members 122 preferably steel L-shaped brackets that have been steel angle rolled or otherwise formed in a desired curved configuration or radius. Curve defining and reinforcing members 122 have a vertical flange 124 and a horizontal flange 126 and are configured to fit into the top portion of the upper T-shaped strengthening rib 44 and/or the lower T-shaped strengthening rib 38. For example, if curve defining and reinforcing members 122 are used in the upper T-shaped strengthening rib 44, portions of the vertical flange 124 will rest against the rear side 34 of wall portion 30 and the horizontal flange 126 will rest against the horizontal flange 56 of the upper T-shaped strengthening rib 44.

Preferably, at least the ends of the curve defining and reinforcing members 122 are attached to the dasher board sections 118 by conventional hardware. Vertical holes 128 are provided in at least the ends of horizontal flange 126 and holes, not shown, are also provided at corresponding locations on horizontal flange 56 and/or 58 of the upper and/or lower T-shaped strengthening ribs 44 and/or 38. Mounting hardware, for example, bolt 132, lock nut 134, and washers 136, is used in a conventional manner by passing the bolt 132 through the aligned holes and threading the lock nut 134 onto bolt 132. This fixes the curve defining and reinforcing members 122 to the dasher board sections 118, and maintains the dasher board sections 118 at their desired curvature.

Additionally, the curve defining and reinforcing members 122 are preferably positioned such that their ends do not correspond to the juncture between adjacent dasher board sections 118. The curve defining and reinforcing members 122 also serve to retain the adjacent board sections 118 in the end-to-end relationship such that the mounting clips 26 positioned at the junction between the curved sections 118 may need not be affixed to the strengthening ribs 38 and 44. However, additional holes may be provided in the curve defining and reinforcing members 122 in alignment with the mounting clip holes 110 if it is desired to use the two attachment systems together. Further, if desired, the curve defining and reinforcing members 122 may be shaped and sized to frictionally fit within the T-shaped ribs 38 and 44 for attachment there between.

Figure 12:
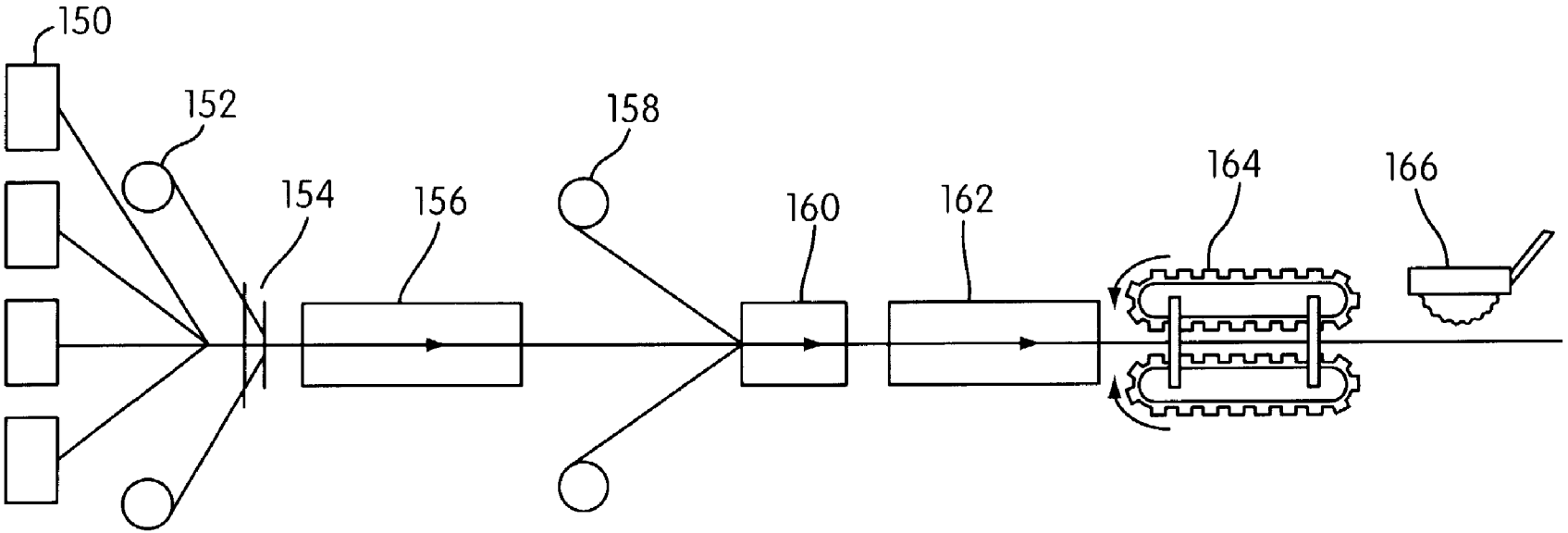
FIG. 12 PRIOR ART
FIG. 12 is a schematic view illustrating a pultrusion process known for making other products, but used in the present invention to make the dasher board sections.

The dasher board sections are preferably made by a process called pultrusion. Pultrusion is a well known method of manufacturing some reinforced plastic shapes that includes continuously pulling resin rich reinforcements through a heated steel die to form profiles of constant cross section of continuous length. While pultrusion has been used to form many different products, it is believed that pultrusion has not been used for dasher board sections. A schematic representation of the pultrusion process is shown in FIG. 12.

Typically, unidirectional glass roving 150 begins the process. This is the fiber that runs along the length of the profile. Roving 150 is made up of fiberglass unidirectional filaments, which are manufactured in continuous rolls. Roving in pultruded products typically comprises 50% to 70% of the total glass content. In addition to supplying the necessary strength to pull the profile, roving provides the product with high tensile, flexural properties and is a big contributor to the overall section stiffness. Generally, fiberglass roving is used in pultrusion to achieve the required properties. As an alternative to fiberglass, graphite roving can be used where more stiffness is desired, and polyester roving may be used where more flex is desired. For the dasher board sections 18 of the present invention, fiberglass roving is preferred.

One or more fiberglass mats 152 preferably provide the remainder of glass reinforcement used in the pultrusion process, and it typically includes 30%–50% of the total glass content. The mats 152 are multidirectional reinforcements and are used to obtain the desired transverse properties of the product. Whereas the roving 150 ties the composite together in the longitudinal direction, the mats 152 are responsible for typing the composite together in all directions, but mainly in the transverse direction.

Unlike hand-layed-up or press-molded processes which use short chopped fibers, the pultrusion process includes a multidirectional mat that has good pull strength to facilitate getting it to the die after it has been wet-out with the resin. Continuous strand mat is commercially available for the pultrusion process and offers good wet-out characteristics, conformability to a variety of shapes, and good physical properties including the required pull strength. However, as an alternative to continuous strand mats, it may be desirable to use woven roving, stitched roving, and woven fabrics to increase the desired transverse properties. For the dasher board sections of the present invention, an arrangement of at least six mats, extending from strengthening rib to strengthening rib, is preferred.

The individual strands and mats are routed from their respective supplies, through a guiding device 154, and into and through a liquid resin bath 156. This thoroughly saturates or "wets-out" every fiber with a thermoset resin. Generally, two types of resins are most often used in the pultrusion process. They are polyester resin and vinyl ester resin. A polyester resin is a preferred resin for the dasher board sections of the present invention. The polyester resin preferably contains ultraviolet inhibitors, and is desirable because it exhibits good corrosion resistance and excellent mechanical properties.

Before the material is pulled into a heated die 162, a surface veil 158 may be added to enhance the surface appearance of the final product. The veil 158 is added to the outside of the profile prior to entrance of the die. As a result, the finished profile has a resin-rich surface which aids in resistance to ultraviolet degradation and makes the profile more hand-friendly. The resin soaked fibers and mats, are then passed through preformers or a series of guides 160. The preformers 160 slowly conform the product to its final shape for entry into the heated die 162.

After the preformers 160, the next stage in the pultrusion process is the curing of the composite. The curing or hardening occurs while the wet-out reinforcements are being pulled through the heated die 162. As the resin is a thermoset resin, the heat from the die causes the resin to cure. By the time the part exits the die, a hard part in the exact shape of the die cavity has been formed. The final result is a solid, rigid profile with all the reinforcements, that is the strands and mats, laminated within. Accordingly, the dasher board section 18, with its wall portion 30 and strengthening ribs 36, 38, 40, 42, 44, and 46, is pultruded and the strengthening ribs 36, 38, 40, 42, 44, and 46 are thus integral and monolithic with the wall portion 30.

Throughout this process, a puller 164 is gripping and pulling the product. In fact, pultrusion gets its name from this pulling process. A drive system for the puller 164 keeps the product moving. The product exiting the puller 164 passes by a cut-off saw 166, which cuts the product into the desired lengths. The cutting of the strengthening ribs to make curved dasher board sections 118 is preferably done at another station.

Some details of the dasher board sections 18 may be affected by the specific pultrusion arrangement used. For example, while it is preferred that all internal and external corners are rounded, the radii of each corner may depend upon the placement and grouping of the fibers and mats used in the pultrusion process.

One significant advantage of the present invention over molded dasher board sections of the prior art is the exceptional strength-to-weight ratio that can be obtained by the pultrusion technique. For example, the pultrusion process permits the dasher board sections 18 and 118 to include a fiberglass content of 50% or more by volume. In contrast, the prior art molded dasher board sections are limited by the amount of fiberglass they contain because of their molding process, and thus typically only include, at most, a fiberglass content of 30% by volume.

The improvement of the strength-to-weight ratio of the current invention also permits the present invention to use longer dasher board sections without encountering human limitations. The prior art steel framed dasher board sections typically weigh about 260 pounds, without hardware, and are 8 feet in length and 42 inches high. Human limitations, e.g., how much a person can lift, become significant assembly issues when dasher board sections approach and/or exceed this weight. The present invention includes dasher board sections that are 20 feet long and 42 inches high, but each weighs approximately 237 pounds, without hardware. Thus, the present invention permits dasher board sections to be used that are 150% longer than the molded prior art dasher boards, but which actually weigh less.

Another significant advantage obtained by utilizing the pultrusion process is the cost savings that can be obtained over the prior art molded designs. A single pultrusion machine can be used to form straight and curved dasher board sections, and dasher board sections of varying length. In contrast, the prior art molded designs require a separate mold for each board section variation.

Moreover, the length of the dasher board sections is only realistically limited by shipping and handling constraints. Thus, the dasher board sections of the present invention can easily be made in lengths of 20–25 feet long. Whereas, molded dasher board sections are frequently only 8 feet in length, likely, at least partly, due to the constraints of the molding machinery required to make the sections.

Referring back to FIGS. 1–3 and 10, the transparent upper shielding 14 is preferably made of a clear polycarbonate sheet, e.g., LEXAN, having a thickness equal to or less than 0.125 inches. The shielding is preferably initially supplied in rolls 180 which facilitates installation. The shielding 14 preferably includes upper holes 182 and lower holes 184 along its length adjacent its top and bottom edges, respectively, for attachment purposes.

To attach the transparent upper shielding 14 around the playing surface, an upper wire 186 is routed through the upper holes 86 in the posts 68. Similarly, a lower wire 188 is routed through the lower holes 88 in the posts 68. In a preferred design, the wires 186 and 188 are clear coated wires with a 0.125 inch diameter. A fastening element 190, which may be a nylon quick tie, a cable tie, a U-shaped crimp device, staples, or any other suitable element, is inserted through each hole 182 and 184 and wrapped around a respective wire 186 or 188 to couple the transparent upper shielding 14 to the wires 186 and 188. The wires 186 and 188 are pulled and tied-off to tension the shielding 14. This design eliminates the need for thick glass and acrylic panels inserted between vertical frames. By using a single sheet from a roll, upper shielding may be provided at a fraction of the price of the currently used transparent shielding designs.

As previously discussed, different shielding heights may be desired. However, a single uninterrupted portion of shielding material may be used for each segment of upper shielding that has a constant height. For example, if a constant shielding height was desired around most of the rink, an uninterrupted sheet of shielding having a length of 144 feet could be used.

To install the dasher board system 10, the supports 16 are mounted to a base supporting surface 29. The base supporting surface 29 need not be a raised perimeter curb 20 as shown in FIG. 3, and may be any surface including asphalt, concrete, or even dirt. In fact, a raised perimeter curb 20 would likely be seen only in an ice rink installation where it is helpful to retain water. This dasher board system 10 can be used with street and roller hockey surfaces as well.

Next the upper shielding 14 is installed by routing the wires 186 and 188 through the holes 86 and 88 in the posts 68. The upper shielding 14 is unrolled around a desired area, and ties 190 are used to couple the shielding to the wires 186 and 188. The wires 186 and 188 are pulled and tied-off to tension the shielding 14. If shielding is desired in other areas, this process is repeated for each constant-height segment of shielding 14.

The dasher board sections 18 and 118 are formed to their desired lengths according to the above-described pultrusion process. Curved dasher board sections 118 may be formed by cutting the strengthening ribs, bending the section 118 at the locations of the cuts 120, and inserting and attaching curve defining and reinforcing members 122 into the upper portions of the upper and/or lower T-shaped supporting ribs 38 and 44.

The mounting clips 26 are loosely attached to the supports 16. The dasher board sections 18 and 118 are placed in an end-to-end configuration around the playing surface and against the supports 16. The mounting clips 26 are raised to conformingly fit within the lower portions of the upper and/or lower T-shaped supporting ribs 38 and 44. The mounting clips 26 positioned at the junction between adjacent dasher board sections 18 and 118 are affixed to the dasher board sections 18 and 118. This effectively completes the installation of dasher board system, exclusive of installation of gate and/or team boxes as described below.

In a preferred embodiment, the shielding extends a small distance, for example 1 inch, below the top of the dasher board sections 18 and 118. With this arrangement, the rear edge 54 of the upper strengthening rib 46 serves to clamp this lower extension of the upper shielding 14 between the dasher boards sections 18 and 118 and the supports 16. In effect, the lower edge of the shielding will conform to the perimeter of the dasher boards sections 18 and 118, and the top edge of the shielding will substantially conform to the upper wire 186 which will remain tensioned in a straight line between adjacent supports 16. Thus, a very slight fishbowl effect can be formed by this arrangement. Optionally, flexible or inflexible straps, not shown, may be placed with each strap extending vertically along the front surface of the upper shielding 14 and having a first end inside the top of a respective post 68 and a second end clamped to the post 68 by the dasher boards sections 18 and 118. In one design, the straps could be made from molded or extruded aluminum strips. The straps would then hold the upper shielding 14 in place by pulling the shielding profile against the posts 68 to periodically clamp and/or compress the upper shielding. If desired, this arrangement may be used to eliminate the previously described fishbowl effect and the need for upper wire 186 and upper holes 182. A felt or foam cushion can be applied to the aluminum strips and/or posts 68 to isolate the transparent upper shielding 14 from the metal components to minimize scratching, wear, and and cracking of the shielding 14.

Figure 13:
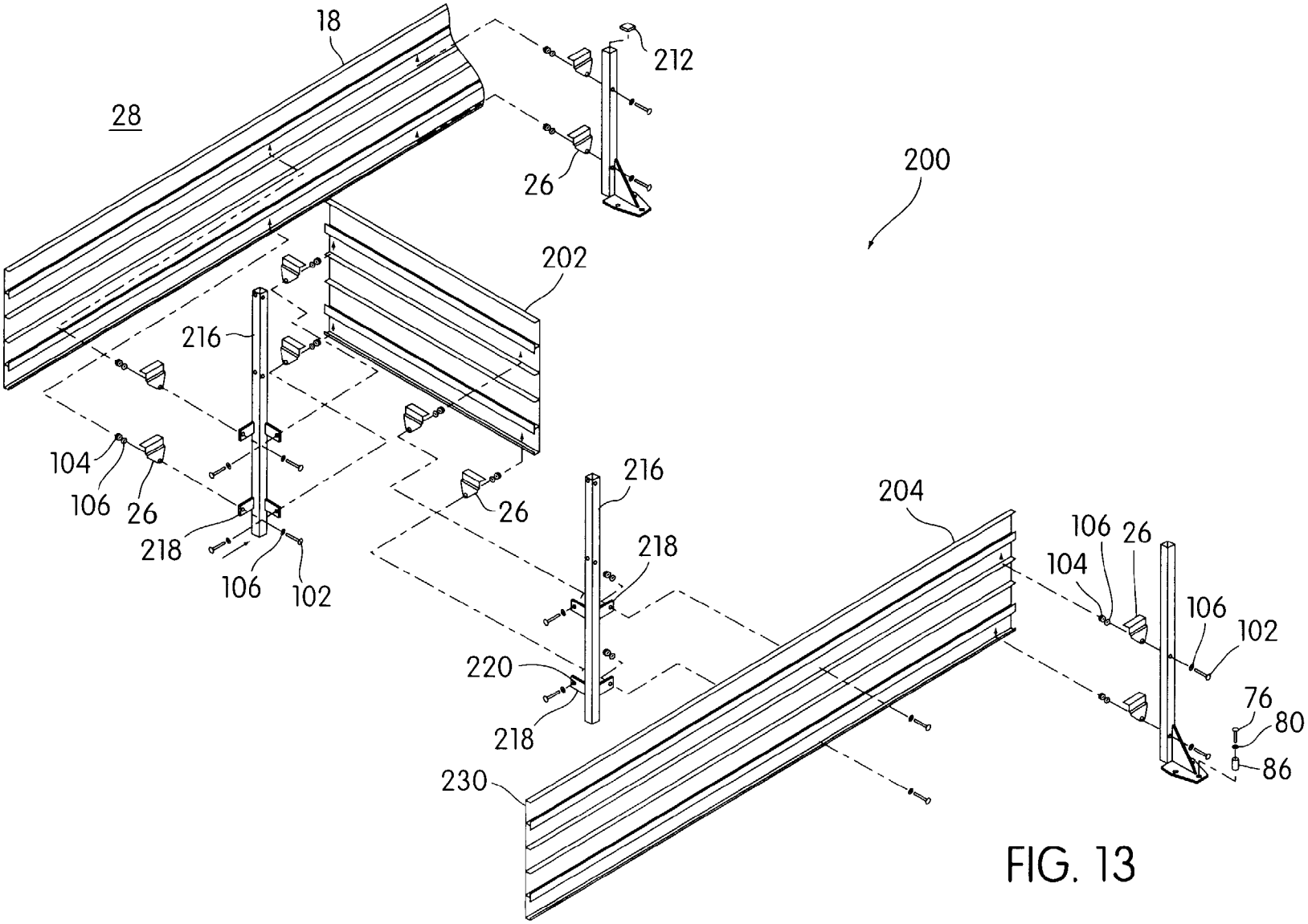
FIG. 13 is a perspective assembly view of the dasher board system showing the portion of the system having a team box.

FIG. 13 illustrates a team box design 200 for a hockey rink. In essence, team box 200 is formed by adding end walls 202 and a back wall 204, each that utilizes the same pultruded sections but cut to a desired length. Supports 216 are preferably placed at the corners between the dasher board section 18 and the end walls 202, and the end walls 202 and the back wall 204. The supports 216 differ from supports 16 by including laterally flared brackets 218 attached to the posts 216. The mounting clips 26 are attached to holes 220 in brackets 218 in lieu of the mounting clip holes 82 and 84. Further, posts 216 inside the team boxes 200 need not include a baseplate or gusset as these posts 216 are aimed at coupling the walls 202 and 204 and sections 18 together. Additionally, as shown in FIG. 13, posts 16 and 216 that terminate at the top of board sections 18 and do not upper shielding 14 are preferably capped by a tube cap top 222 to prevent possible injuries. Indeed, capping the top of the supports is preferred throughout the dasher board system 10. Moreover, if the design of a team box 200 requires mounting to both sides of a wall section, for example back wall 204, holes, not shown, may be drilled in the wall portion 230 between the strengthening ribs. Alternatively, the back wall 204 may be reversed so that the ribs will face the inside of the team boxes. This enables benches, tables, and other devices to be mounted directly to the inwardly facing strengthening ribs.

Figure 14:
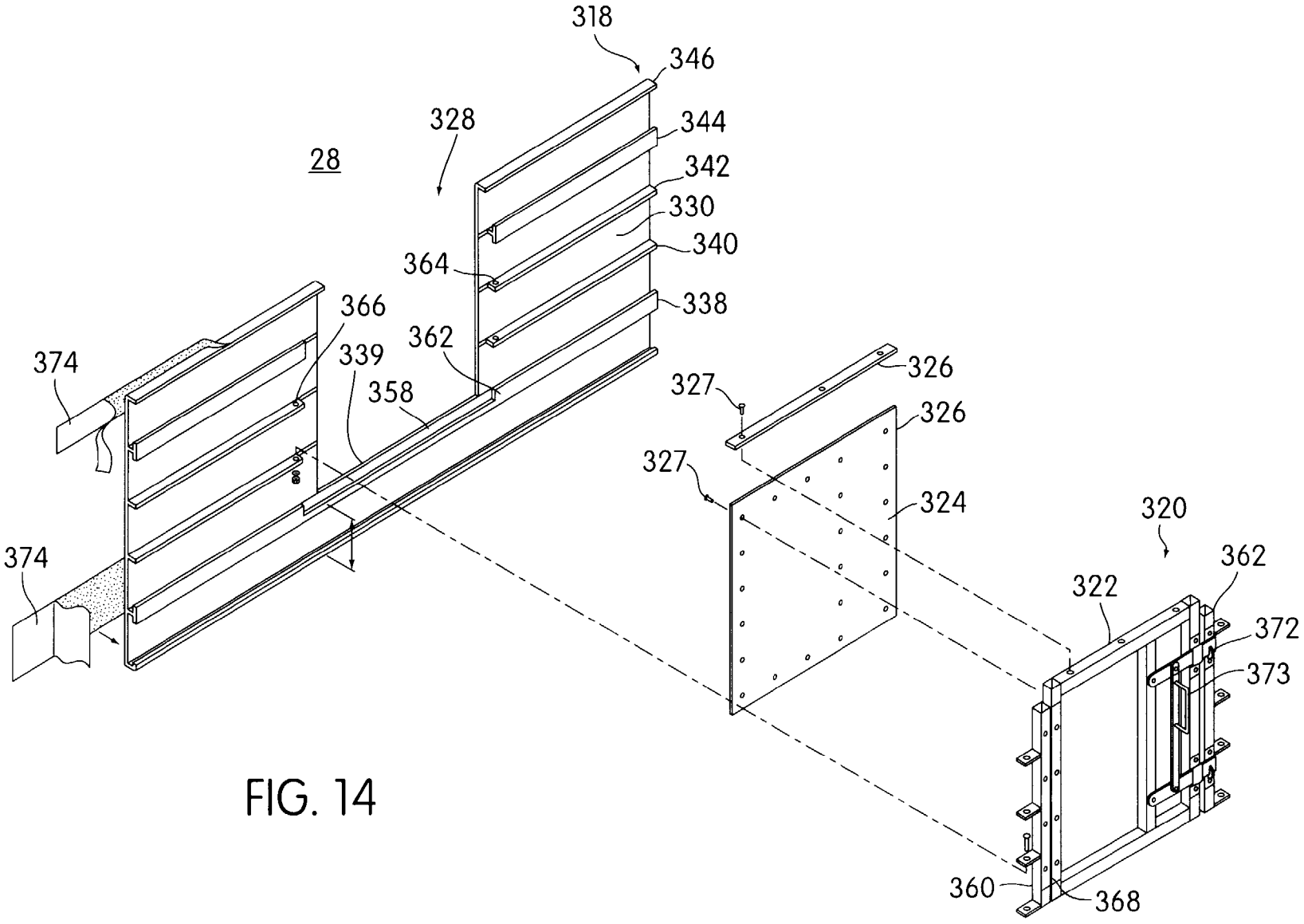
FIG. 14 is an exploded assembly view of a dasher board section having a pivotal rink entry/exit gate.

FIG. 14 shows a dasher board section 318 provided with a gate or pivotable door 320 therein. The door 320 may be formed by a tubular galvanized steel door frame 322 that is faced with a fiberglass panel 324 and capped with another piece of fiberglass 326. The pieces of fiberglass 324 and 326 are preferably attached to frame 322 by conventional hardware, e.g., rivet-like retaining plugs 327. The dasher board section with gate 318 includes a rectangular cutout 328 therein that corresponds to the size of the door 320. The cutout extends through the wall portion 330 in addition to the four uppermost strengthening ribs 340, 342, 344, 346. The top portion of vertical flange 362 of lower T-shaped strengthening rib 338 is also removed to enable the horizontal flange 358 of that rib 338 to act as a step 339.

The ribs 338, 340, 342, 344, 346 are also cut away a distance from the door 320 on both sides of the door 320. This enables a hinge tubular support 360 and a catch tubular support 362 to be mounted to the dasher board section 318 through aligned holes 364 and 366 on both sides of the door 330. A hinge 368 is connected between hinge tubular support 360 and frame 322 to enable door 320 to pivot Catch tubular support 362 includes two catches on it 370 such that a conventional door latching mechanism 372 can be used to lock and unlock, and open and close the door 320 with a handle 373.

In an alternative arrangement to FIG. 14, the door 320, including the frame 322 and the panels 324 and 326, could be replaced by the dasher board section removed from the rectangular cutout 328. Suitable hardware would be used to pivotally mount the removed door section to the remaining dasher board section 318. A similar door latching arrangement could also be used and would preferably be mounted to the strengthening ribs on either side of the cutout 328.

FIG. 14 also illustrates optional adhesive strips 374 that can be used to simulate the effects of a kickstrip and/or a sill strip to be attached to the bottom or top of all dasher board sections 18, 118, 318. In the alternative, solvent-based paint, epoxy paint, dyed resin, plastic elements, or nothing may be used in lieu of the adhesive strips 374.

Figure 15:
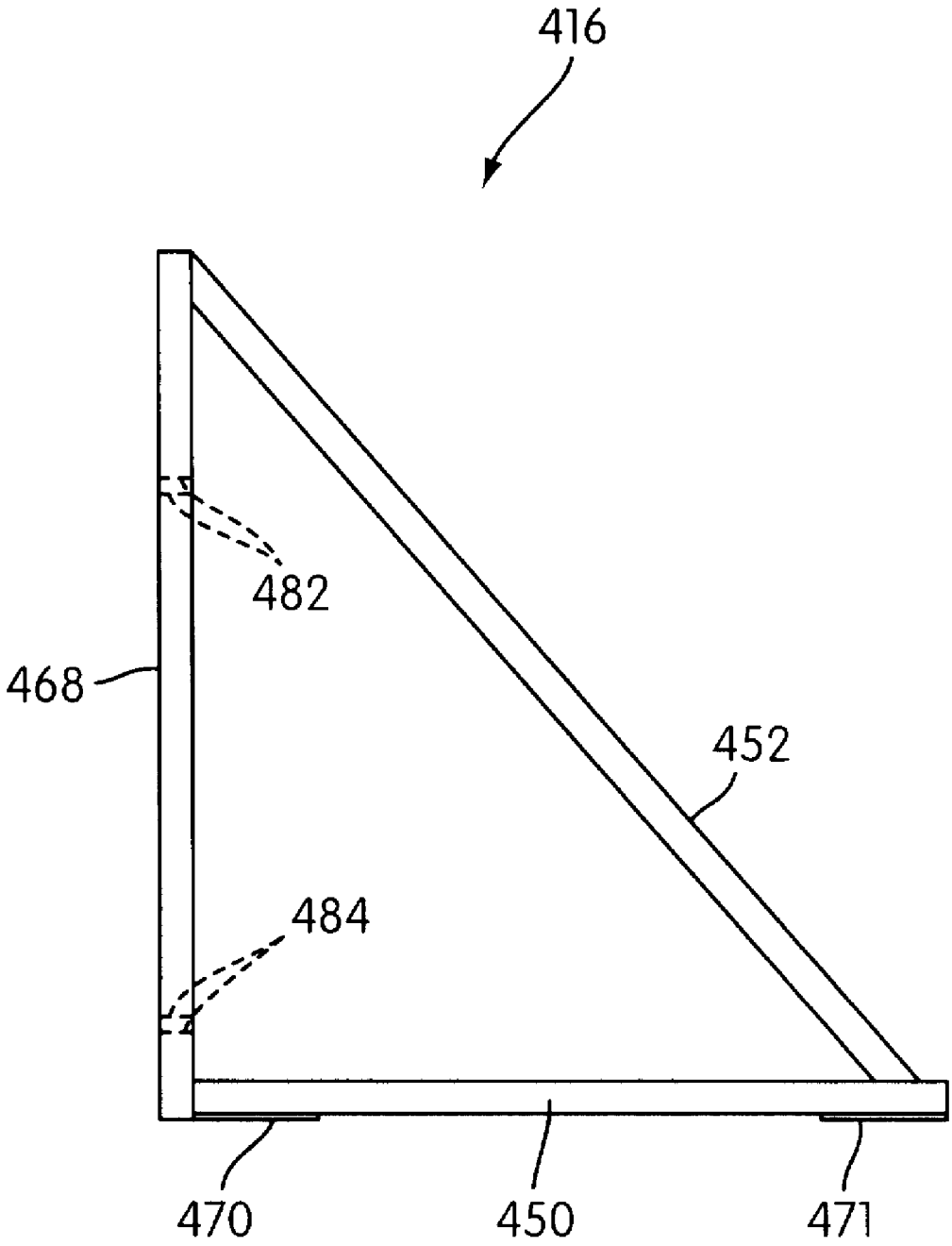
FIG. 15 is a side elevational view of a support for mounting the dasher board sections in an alternative rink setting.

A support 416 is shown in FIG. 15 for an application where it is undesirable to place fasteners into the ground or base supporting surface. Such a situation may arise in when it is desirable to convert a tennis court into a street or roller hockey rink for the winter, or when it is desirable to may a hockey rink in a gymnasium for a short period of time. As with support 16, support 416 includes clip mounting holes 482 and 484. However, support 416 differs in that the smaller horizontal baseplate 70 and gusset 72 arrangement of support 16 has been replaced by a large tubular horizontal support 450 and a tubular diagonal support 452 attached at its ends to the top of post 468 and the rear end of horizontal support 450. The horizontal support 450 also has front and rear baseplates 470 and 471 attached thereto. The bottom of the baseplates 470 and 471 may include a rubber cushioning element if desired to minimize the defacement of surfaces prone to being scratched. This support 416 would be attached to a dasher board section with mounting clips in the same manner as support 16.

Figure 17:
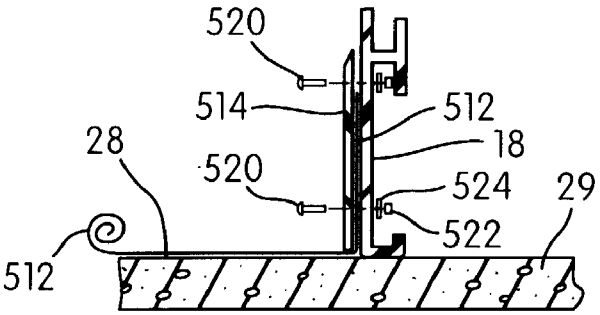
FIG. 17 is an enlarged detail of the lower portion of FIG. 16 showing the attachment of an optional liner.
Figure 18:
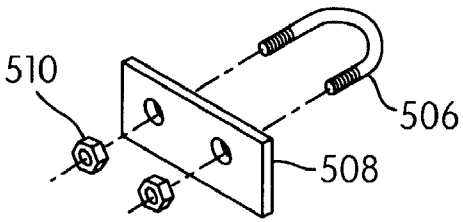
FIG. 18 is an exploded perspective view of the hardware for mounting the dasher boards to the chain link fence.
Figure 16:
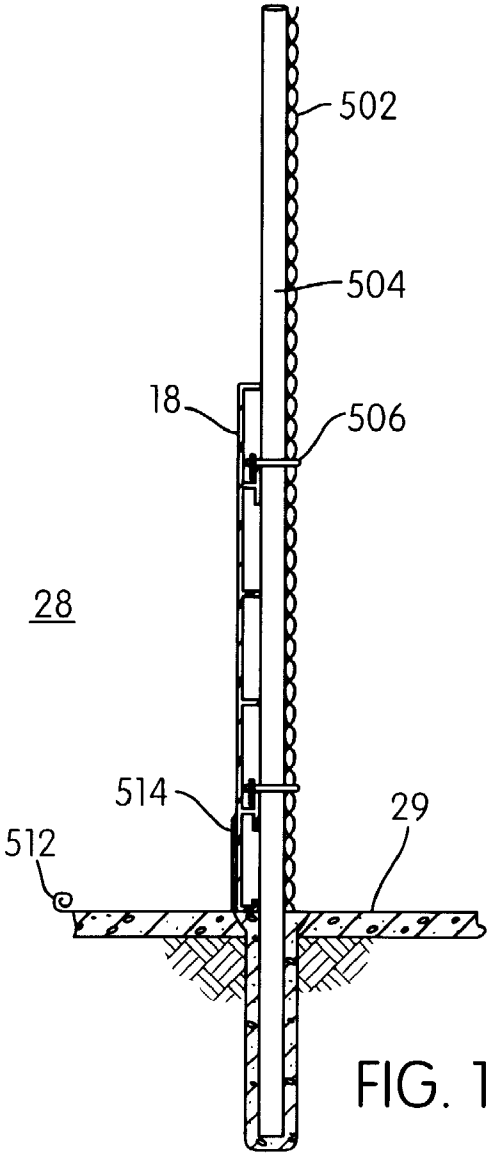
FIG. 16 is a cross sectional view of the dasher board system mounted to an existing chain link fence.
Figure 22:
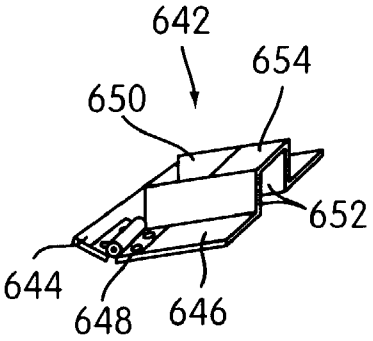
FIG. 22 is a perspective view of the lockdown mechanism used in the support of FIG. 19.

As shown in FIGS. 16–18, the dasher board sections 18 can be used to be attached in an area enclosed in a chain link fence 502. Such may be the case with some tennis courts. The dasher board sections 18 are attached to an existing fence post 504 in lieu of a support 16. The dasher board sections 18 are preferably connected to the existing fence posts 504 by using a U-bolt 506, a retainer plate 508, and nuts 510. The U-bolt 506 is inserted through the fence 504 and around a post 504. The retainer plate 508 is placed on the end of the U-bolt such that the bottom end of the retainer plate 508 engages a vertical flange 60 or 62 on the dasher board section 18. Lock nuts 510 are then tightened to clamp the dasher board panel 18 to the fence 502.

Optionally, the playing surface area, for example the tennis court, can be converted to an ice hockey rink by laying a polyurethane liner 512 on the ground between the dasher board panels 18. A kickplate 514 is attached to the bottom of the dasher board panels 18 by conventional hardware, e.g., screw 520, nut 522, and washer 524. The liner 512 can be clamped in between the kickplate 514 and the bottom of dasher board panels 18 to form a sealed area extending up to approximately the height of the kickplate 514. Water can be deposited onto the liner 512 to retain water. If the temperature drops below freezing, the water will freeze and an ice rink will be formed.

Figure 19:
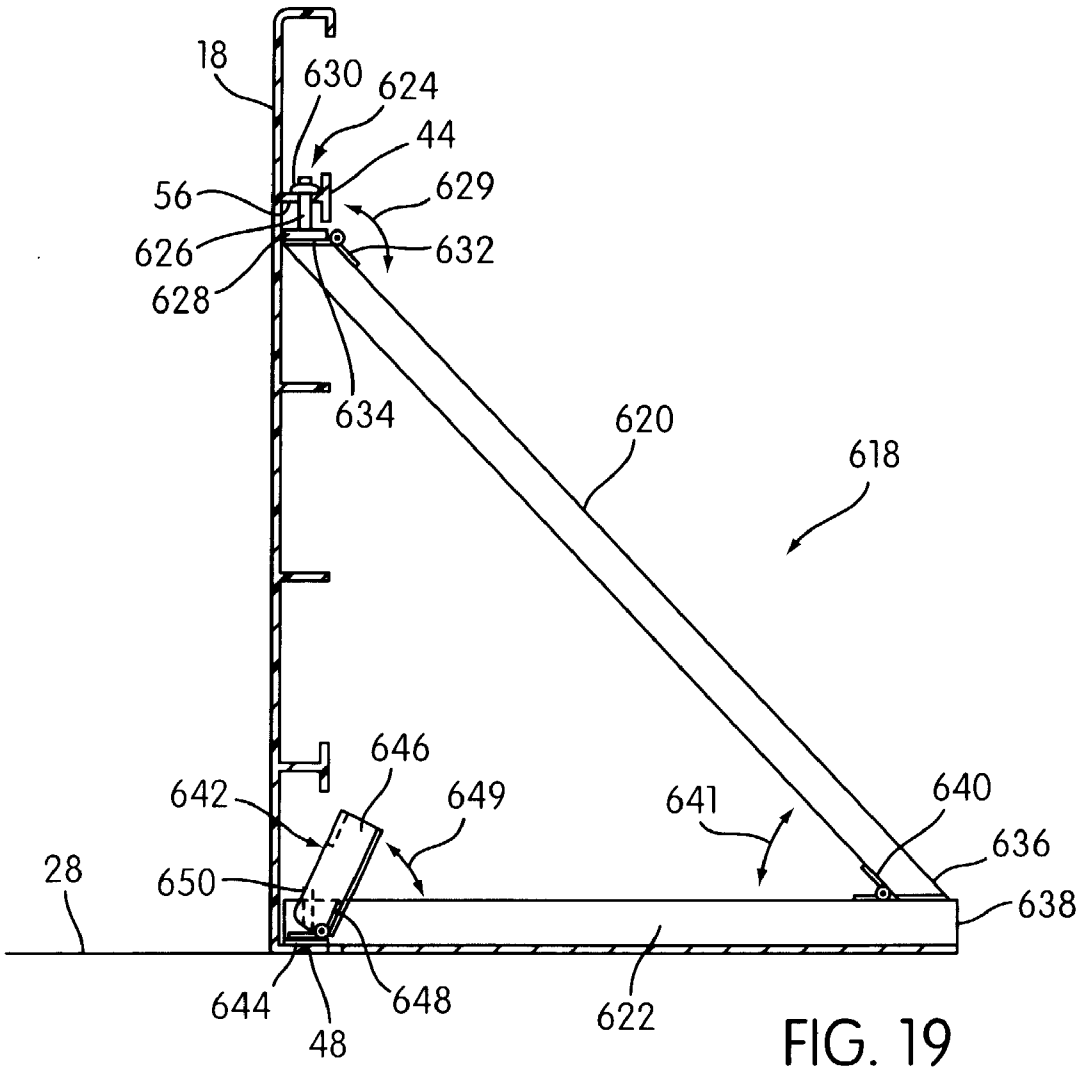
FIG. 19 is a side elevational view of a dasher board section mounting in an alternative rink setting using an alternative support in an in-use position.
Figure 21:
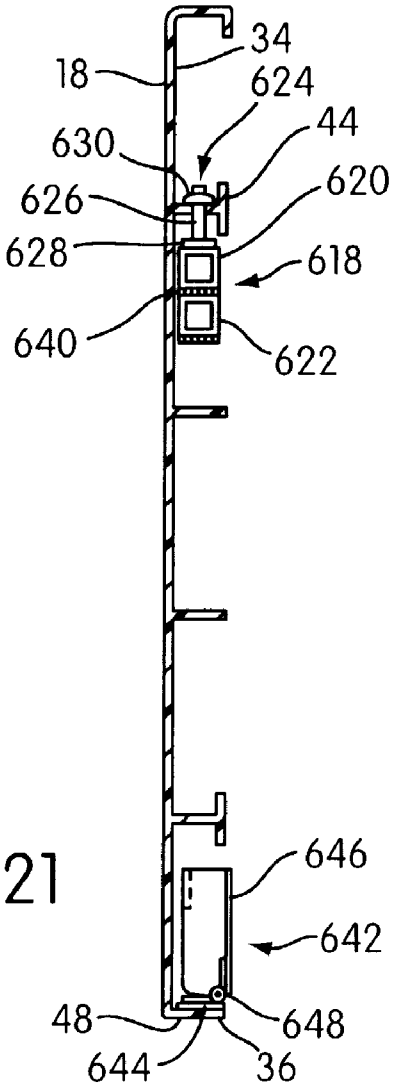
FIG. 21 is a side elevational view of a dasher board section and support of FIG. 19, shown in a storage or non-use position.

FIGS. 19–22 illustrate a mounting support assembly 618 for dasher board sections 18 and 118 that is movable between an in-use position, as shown in FIG. 19, and a storage position, as shown in FIG. 21. Mounting support assembly 618 includes a first or upper support 620 coupled at a top end 634 to its respective dasher board section 18, and a second or lower support 622 coupled to the other or bottom end 636 of the angled support 620. In an in-use position, the lower support 622 is horizontally oriented on top of the ground or supporting surface to support the dasher board section 18 in use so that dasher board section 18 provides a boundary wall for the rink surface 28. Further, upper support 620 is angled between the dasher board section 18 and the rear end 638 of the lower support 622 to transfer forces to the lower support 622 and stabilize the dasher board section 18. As shown in FIG. 21, in storage, the upper and lower supports 620 and 622 fold up in between the strengthening ribs 42 and 44 of the dasher board section 18 so that the dasher board sections 18 can be effectively stored in a minimal space by permitting the dasher board sections 18 to be stacked.

Figure 20:
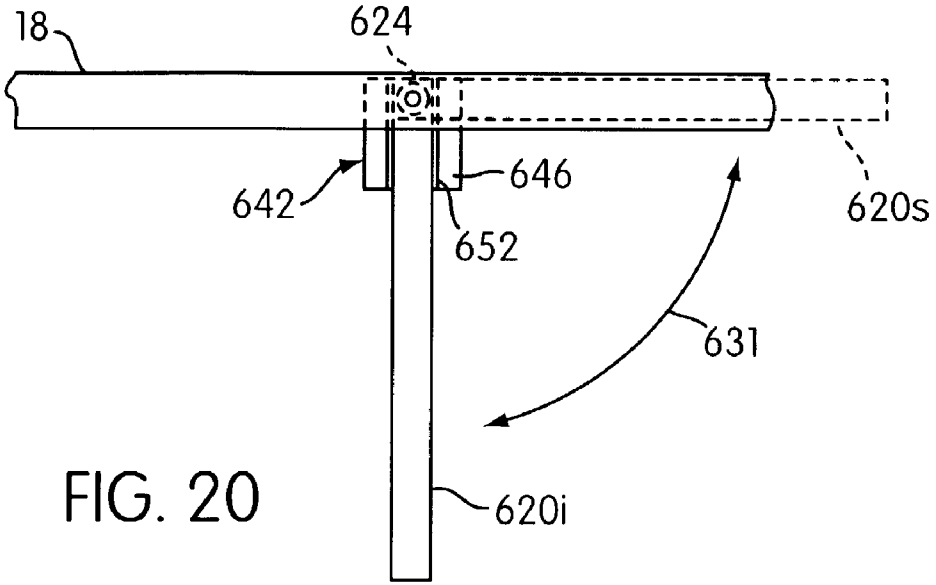
FIG. 20 is a top plan of FIG. 19 with the support shown in an in-use position in solid line, and in a storage-position in broken line.

To accomplish this folding arrangement, a swivel 624 is preferably mounted to the horizontal flange 56 of the upper T-shaped strengthening rib 44. Swivel 624 includes a vertical shaft 626 extending through a hole in the horizontal flange 56, a base 628 below the horizontal flange 56, and a retaining member 630 above the horizontal flange 56 for retaining the swivel 624 to the flange 56. A hinge 632 includes a first portion mounted to the base 628 and a second portion mounted to the top end 634 of the upper support 620 to enable upper support 620 to pivot with respect to the base 628 about a horizontal axis in the direction of arrow 629. The top end 634 of upper support 620 is cut at an angle so that it is parallel to the base 628 when in an in-use position. As best shown in FIG. 20, swivel 624 permits the upper support 620, with lower support 622 coupled thereto, to pivot about a vertical axis in the direction of arrow 631 between a storage position 620*s* where support 620 is against the rear side 34 of the dasher board section wall portion 30, and an in-use position 620*i* where support 620 extends perpendicularly away from the length of the dasher board section 18.

The bottom end 636 of upper support 620 is pivotally attached to the rear end 638 of lower support 622 by a hinge 640. The permits relative pivotal movement in the direction denoted by arrow 641 between the supports 620 and 622 about a horizontal axis. The bottom end 636 of upper support 620 is cut at an angle to the length of the support 620 so that it is parallel to the top of the lower support 622 when in an in-use position. The bottom surface of the lower support 622 is preferably provided with a rubber coating or strip 643. This permits safe use of the dasher board system on wooden or other floor surfaces that are sensitive to scratching.

A lockdown device 642 includes a mounting flange 644, a locking member 646, at least one hinge 648 mounted between the mounting flange 644 and the locking member 646 to permit relative pivotal movement about a horizontal axis between the mounting flange 644 and the locking member 646 in the direction of arrow 649. Mounting flange 644 may be attached to horizontal flange 48 of lower strengthening rib 36 in any conventional manner, e.g., mounting hardware or an adhesive. In a storage position, as shown in FIG. 21, locking member 646 is in a vertical position to permit it to be effectively stored in a minimal space.

Locking member 646 includes a locking channel 650 having opposing vertical wall sections 652 and an upper horizontal wall section 654. The opposing vertical wall sections 652 are spaced apart by a distance slightly greater than the width of lower support 622. The spacing between the bottom of locking member 646 and the bottom of the upper horizontal wall section 654 is greater than the height of lower support 622 and helps to keep the opposing vertical wall sections 652 fixed with respect to one another. Accordingly, when the locking member 646 is lowered onto lower support 622, it restrains the lateral movement of lower support 622 to guarantee that the dasher board section 18 remains supported.

To move the support 616 from an in-use position to a storage position, the locking member 646 is pivoted about hinge 648 to lift it to a vertical position. The lower support 622 and the upper support 620 are lifted to pivot about hinges 640 and 632 until they both are in a horizontal position. The supports 620 and 622 are rotated about the vertical axis provided by swivel 624 to be moves against the rear of the dasher board section 18. If desired, holding straps or devices, e.g., VELCRO, can be placed on engaging elements to help maintain the elements in the storage position in absence of a significant force. To move the support 616 back to its in-use position, the process is reversed.

The number and spacing of support assemblies 616 per dasher board section 18 can be selected based upon the expected use and desired strength. Additionally, mounting clips 26. as described earlier herein, would preferably be used as an attachment between adjacent board sections 18 to maintain alignment between the sections. The support assemblies 616 would be mounted to curved dasher board sections 118 in the same manner. However, it should be noted that the curve defining and reinforcing members 122 are first removed to store the curved sections 118 in a flattened position with the assemblies 616 therein.

In a preferred embodiment, the supports 620 and 622 are made from square or rectangular aluminum tubes and the hinges 632, 640, and 648 are made from stainless steel. However, it is recognized that other materials can be used. Further, it is also recognized that the vertical flange 50 of lower strengthening rib 36 would preferably be notched in the region of supports 620 and 622 to accommodate the locking member 646 and the lower support 622. Alternatively, the locking member 646 may be mounted on top of the vertical flange 50 and rest thereon.

Figure 23:
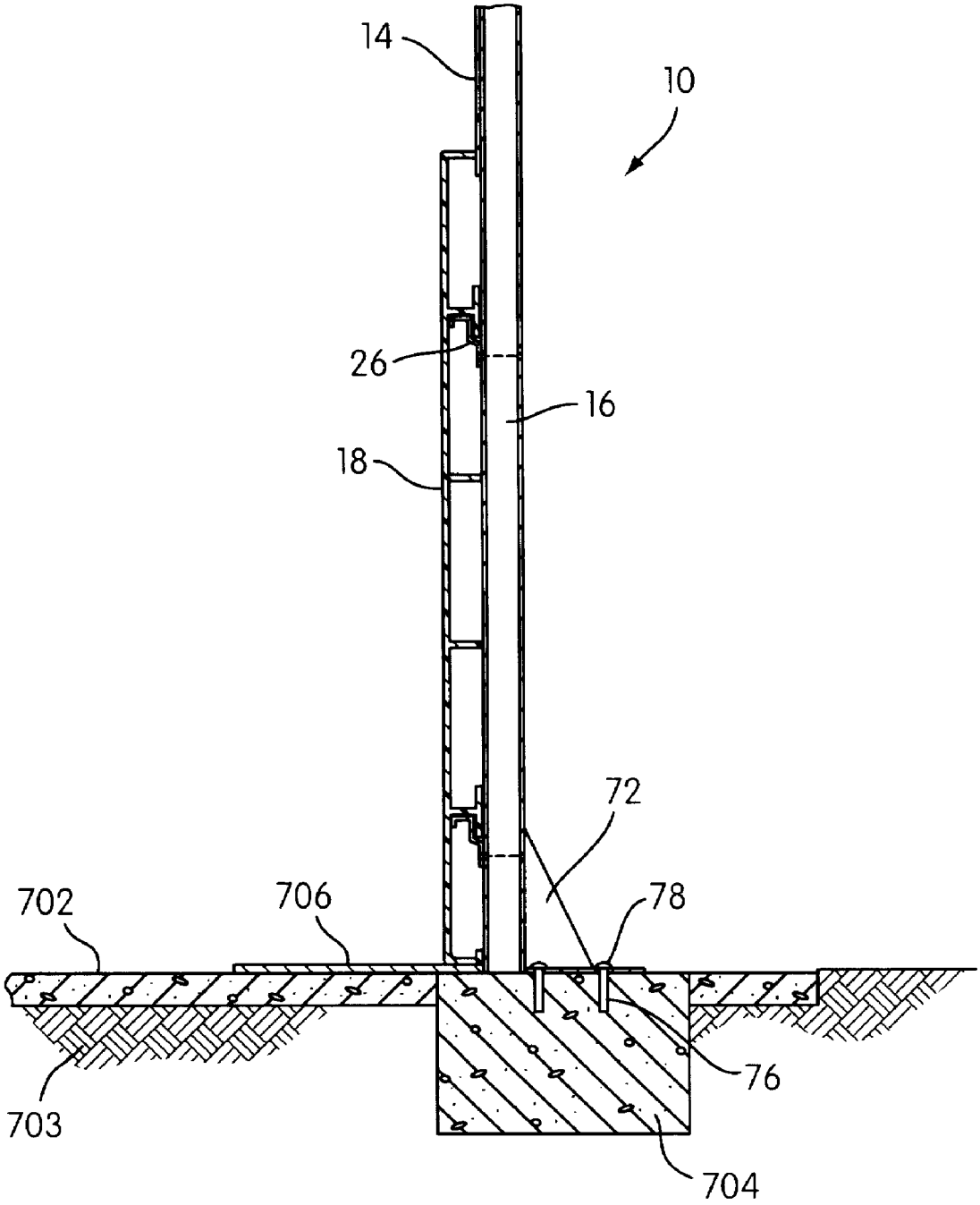
FIG. 23 is a side cross sectional view of the dasher board system, similar to FIG. 3, installed at an asphalt surface with a concrete curb.

The dasher board system 10 of the present invention can be mounted to many different surfaces. For example, many times it is desirable to convert an existing asphalt surface to a hockey rink, usually for street hockey or in-line hockey. FIG. 23 shows the dasher board system 10 installed on an asphalt surface 702. A concrete curb 704 can be formed in the asphalt 702 and the ground 703 that extends around the periphery rink surface immediately below the dasher board sections 18. Formation of such a concrete curb 704 is known and typically consists of saw cutting the existing asphalt and pouring a continuous concrete ring in the cut section. It is recognized that the concrete curb 704 can be initially formed in the asphalt surface 702 and does not need to be poured into a cut ring in the asphalt at a later time. Mounting of the supports 16 to the concrete curb 704 is the same as shown in FIG. 3. That is, high tensile concrete expansion anchors 76 can be positioned in holes in the base supporting surface 29, e.g., concrete curb 704, that are in a pattern and spacing corresponding to the pattern and spacing of the holes 74 in the baseplate 70. Bolts 78 and washers may then be used in a conventional manner so that the bolts 78 extend through respective holes 74 in baseplate 70 and into respective anchors 76 for affixing the supports 16 to the concrete curb 704.

FIG. 23 also shows the dasher board system 10 of the present invention used with an in-line or deck surface 706. In line or deck surface 706 can be any flooring or other surface, preferably a smooth plastic surface, to enable or improve the playing of the sports of in-line and/or street hockey. In this arrangement, the dasher board sections 18 would be mounted above the asphalt surface 702 by a distance slightly greater than the thickness of the in line or deck surface 706 to accommodate such a surface, and to permit the surface to freely expand and contract. However, it is recognized that the in line or deck surface 706 need not be used and the bottom of the dasher board sections 18 may be mounted flush to the concrete ring 704 or the asphalt 702, such as shown in FIG. 24.

Figure 24:
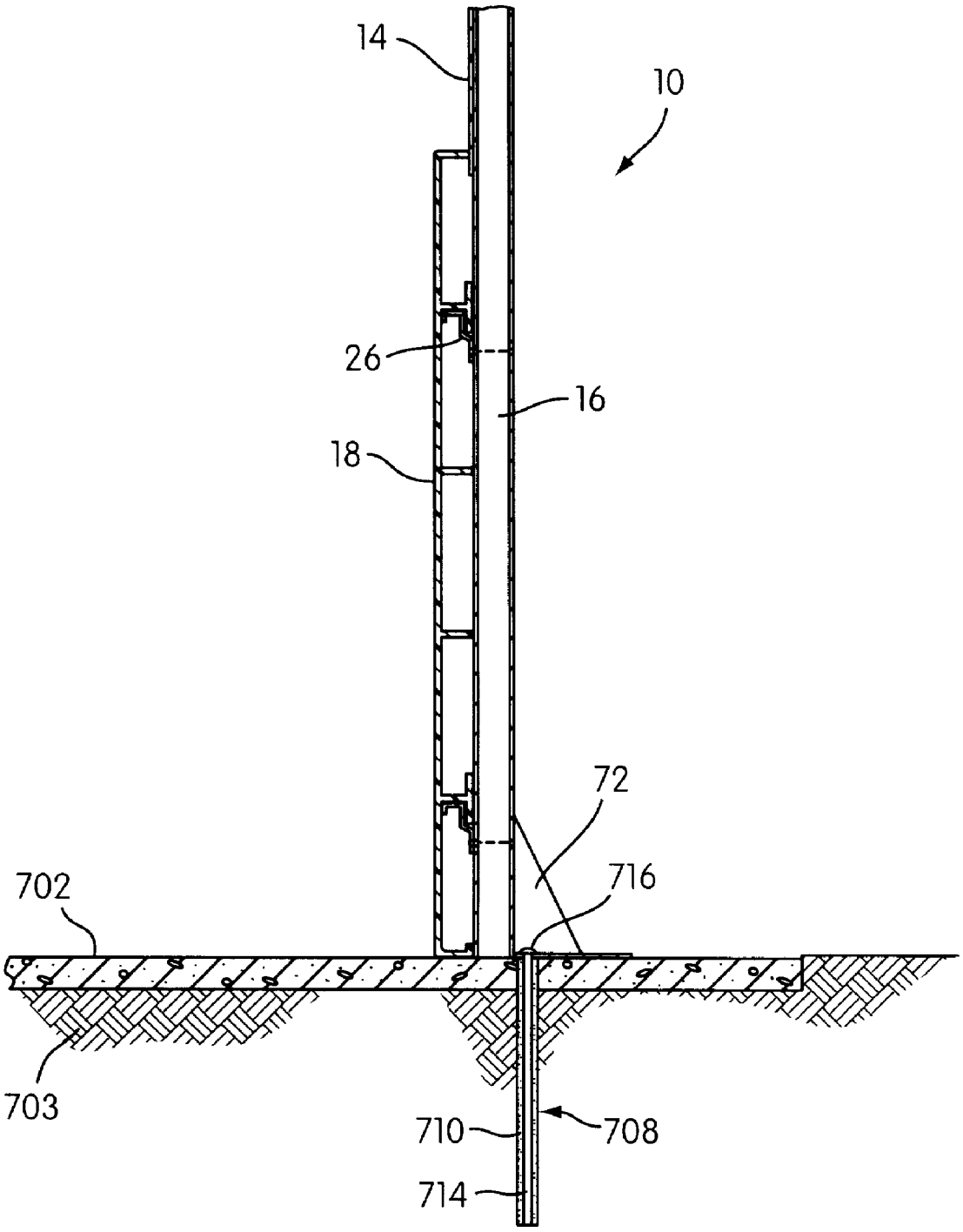
FIG. 24 is a side cross sectional view of the dasher board system, similar to FIG. 3, installed at an asphalt surface without a concrete curb.

FIG. 24 depicts the dasher board system installed at an asphalt surface 702 without a concrete curb. This arrangement is used to convert an existing asphalt surface to a hockey rink in lieu of the poured concrete curb of FIG. 23. This arrangement is preferred over the arrangement of FIG. 23 as pouring a concrete curb may cost up to $15,000, whereas this arrangement inexpensively and securely attaches the supports 16 to the asphalt 702 and earth 703 without the need to pour concrete.

The mounting arrangement of FIG. 24 uses earth anchors 708 that are in a pattern and spacing corresponding to the pattern and spacing of the holes 74 in the baseplate 70. To form the earth anchors 708, a hole is drilled through the asphalt 702 and into the earth 703 corresponding to each hole 74 in the baseplate 70. An epoxy resin capsule 710 that includes an internal wall and a two part composition is inserted into each drilled hole. The epoxy resin capsules 710 are known and used in the mining industry, and one such epoxy resin capsule design is made by Dupont. After the epoxy resin capsules 710 are in place, steel rods having a shaft 714 and a head 716 are inserted through respective holes 74 in baseplate 70 so that the shafts 714 break a respective epoxy capsule 710. The heads 716 of the steel rods remain above the baseplate 70 and are shaped to be engaged by a drill, e.g., the head is square or hexagonal shaped. A drill is used to rotate the steel rods and their shafts 714 to actuate the epoxy capsule 710, and the mixing of the two compositions in the capsule 710 causes the epoxy to harden and form a rigid earth anchor 708. It is recognized that some mechanical anchors may be used in lieu of the epoxy capsule and steel rod anchor arrangement. Additionally, FIG. 24 depicts the dasher board sections 18 mounted flush to the asphalt surface 702. However, it is recognized that the dasher board sections 18 can be mounted in a raised configuration to accommodate a floor surface as shown in FIG. 23.

The invention has been described in detail in connection with preferred embodiments. The preferred embodiments, however, are merely for example only and this invention is not restricted thereto. It would be easily understood by those skilled in the art that variations and modifications can be easily made within this scope of this invention as defined by the appended claims.

What is claimed is:

1. A dasher board system for providing the boundary of a hockey surface, the dasher board system comprising:

a first dasher board section;

a second dasher board section, said second dasher board section and said first dasher board being positioned adjacent each other in an end-to-end relationship;

said first dasher board section having a wall portion, a top, a bottom, a length, and a horizontally extending strengthening rib extending rearwardly from the wall portion, and located between and spaced from the top and bottom of the first dasher board section, said horizontally extending strengthening rib being monolithic with the wall portion, and extending substantially the entire length of the first dasher board section;

a support post; and a mounting member attached to said support post and said strengthening rib for restraining movement of the first dasher board section; said horizontally extending rib includes a first horizontal portion extending horizontally away from wall portion and a vertical portion extending from the horizontal portion distal from the wall portion of the first dasher board section.

2. The dasher board system of claim 1, wherein said second dasher board section includes a top, a bottom, a length, and a horizontally extending strengthening rib located between, and spaced from, said top and bottom, said horizontally extending strengthening rib of said second dasher board section extending substantially the entire length of the second dasher board section.

3. The dasher board system of claim 2, wherein said horizontally extending strengthening rib of said first dasher board section is a first horizontally extending strengthening rib of said first dasher board section, and said horizontally extending strengthening rib of said second dasher board section is a first horizontally extending strengthening rib of said second dasher board section, each said first and second dasher board section further including a second horizontally extending strengthening rib, distinct from its respective first horizontally extending rib, and located between and spaced from its respective top and bottom, each said second horizontally extending strengthening rib extending substantially the entire length of its respective dasher board section.

4. The dasher board system of claim 1, wherein said horizontally extending rib is T-shaped in cross section.

5. The dasher board system of claim 4, wherein said first and second dasher board sections are positioned in an abutting relationship and a junction is defined at a location where the first and second dasher board sections meet, said mounting member being positioned at said junction.

6. The dasher board system of claim 5, wherein said mounting member is a first mounting member and said support post being a first support post, said dasher board system further comprising a second support post and a second mounting member, said second mounting member being coupled to said second support post and said strengthening rib for restraining movement of the first dasher board section, said first mounting member being fixedly attached to the first dasher board section and said second mounting member engaging said strengthening rib but not being not fixedly attached thereto.

7. The dasher board system of claim 1, further comprising transparent upper shielding coupled to the support post.

8. The dasher board system as recited in claim 1, wherein said first and second dasher board sections each have a substantially constant cross-sections along its respective length.

9. The dasher board system of claim 1, wherein said first and second dasher board sections include over 40% fiberglass by volume.

10. The dasher board system of claim 9, wherein said first and second dasher board sections include over 50% fiberglass by volume.

11. The dasher board system of claim 1, further comprising a support assembly, said support assembly being pivotally coupled to said strengthening rib of the first dasher board section for movement between a storage position and an in-use position, said support assembly supporting the first dasher board section when in the in-use position.

12. The dasher board system of claim 11, wherein said support assembly is coupled to strengthening rib permitting pivotal movement about a horizontal axis and about a vertical axis.

13. The dasher board system of claim 12, wherein said support assembly includes a first support member, a second support member, and a hinge pivotally coupling said first and second support members to each other.

14. The dasher board system of claim 1, wherein said first and second dasher board sections are each over 10 feet in length and weigh less than 260 pounds.

15. The dasher board system of claim 14, wherein said first and second dasher board sections are each over 15 feet in length.

16. The dasher board system of claim 1, wherein said first and second dasher board sections are each at least 20 feet in length.

17. A dasher board system for providing the boundary of a hockey surface, the dasher board system comprising:

a first dasher board section;

a second dasher board section, said second dasher board section and said first dasher board being positioned adjacent each other in an end-to-end relationship; and said first dasher board section having a top, a bottom, a length, and a horizontally extending strengthening rib located between and spaced from the top and bottom of the first dasher board section, said horizontally extending strengthening rib extending substantially the entire length of the first dasher board section;

wherein the second dasher board section has a top, a bottom, a length, and a horizontally extending strengthening rib located between and spaced from the top and bottom, said horizontally extending strengthening rib of said second dasher board section having first and second longitudinal ends and being cut at a plurality of spaced locations along the horizontally extending strengthening rib between the first and second longitudinal ends, said second dasher board section being curved in the plurality of spaced locations.

18. The dasher board system of claim 17, wherein said horizontally extending strengthening rib of said first dasher board section is a first horizontally extending strengthening rib of said first dasher board section, and said horizontally extending strengthening rib of said second dasher board section is a first horizontally extending strengthening rib of said second dasher board section, each said first and second dasher board section further including a second horizontally extending strengthening rib, distinct from its respective first horizontally extending rib, and located between and spaced from its respective top and bottom, each said second horizontally extending strengthening rib extending substantially the entire length of its respective dasher board section.

19. The dasher board system as recited in claim 10, further comprising a support post and a mounting member attached to said support post and said strengthening rib for restraining movement of the first and second dasher board sections.

20. The dasher board system of claim 19, wherein said horizontally extending rib is T-shaped in cross section.

21. The dasher board system of claim 20, wherein said first and second dasher board sections are positioned in an abutting relationship and a junction is defined at a location where the first and second dasher board sections meet, said mounting member being positioned at said junction.

22. The dasher board system of claim 21, wherein said mounting member is a first mounting member and said support post being a first support post, said dasher board system further comprising a second support post and a second mounting member, said second mounting member being coupled to said second support post and said strengthening rib for restraining movement of the first dasher board section, said first mounting member being fixedly attached to the first dasher board section and said second mounting member engaging said strengthening rib but not being not fixedly attached thereto.

23. The dasher board system of claim 19, further comprising transparent upper shielding coupled to the support post.

24. The dasher board system of claim 17, wherein said first and second dasher board sections include over 50% fiberglass by volume.

25. The dasher board system of claim 17, further comprising a support assembly, said support assembly being pivotally coupled to said strengthening rib of the first dasher board section for movement between a storage position and an in-use position, said support assembly supporting the first dasher board section when in the in-use position.

26. The dasher board system of claim 25, wherein said support assembly is coupled to strengthening rib permitting pivotal movement about a horizontal axis and about a vertical axis.

27. The dasher board system of claim 17, wherein said first dasher board section further includes a wall portion, said strengthening rib of the first dasher board section being monolithic with the wall portion of the first dasher board section, and said second dasher board section further includes a wall portion, said strengthening rib of the second dasher board section being monolithic with the wall portion of the second dasher board section.

28. The dasher board system of claim 17, wherein said first and second dasher board sections are each over 10 feet in length and weigh less than 260 pounds.

29. A dasher board system for providing the boundary of a hockey rink, the dasher board system comprising:

a first dasher board section;

a second dasher board section, said first and second dasher board sections being positioned adjacent each other in an end-to-end relationship; and first dasher board section having a top, a bottom, a length, and a horizontally extending strengthening rib located between, and spaced from, the top and bottom, said strengthening rib includes portions thereof that have been removed at a plurality of spaced locations along its length that significantly reduces the rigidity of the first dasher board section in the areas of the spaced locations enabling the first dasher board section to flex in the areas of said spaced locations, said first dasher board section being curved in the areas of said spaced locations.

30. The dasher board system of claim 29, wherein said first dasher board section is curved, said first dasher board section including at least one curved mounting member attached to the first board section, said curved mounting member defining a shape for the first dasher board section.

31. The dasher board system of claim 30, wherein said second dasher board section is curved and includes a top, a bottom, a length, a horizontally extending strengthening rib located between, and spaced from, the top and bottom, and at least one curved mounting member attached to the second board section, said strengthening rib of said second dasher board section includes portions thereof that has been removed at a plurality of spaced locations along its length, and said curved mounting member of said second dasher board section defining a shape for the second dasher board section.

32. The dasher board system of claim 31, further comprising a third dasher board section, said third dasher board section being positioned adjacent said second dasher board section in an end-to-end relationship, said third dasher board section being straight and having a horizontally extending strengthening rib.

33. The dasher board system of claim 31, further comprising a sheet of transparent upper shielding extending between and above opposing distal longitudinal ends of the first and second curved board sections.

34. The dasher board system of claim 29, wherein said strengthening portion includes more than two spaced locations along its length that include removed portions.

35. A dasher board system for providing the boundary of a hockey surface, the dasher board system comprising:

a first dasher board section, said first dasher board section including at least 10% fiberglass by volume, and having a length in excess of fifteen feet;

a second dasher board section, said second dasher board section including at least 10% fiberglass by volume, and having a length in excess of fifteen feet, said second dasher board section and said first dasher board being positioned adjacent each other in an end-to-end relationship and being attached to restrain movement therebetween; and each said first and second dasher board section further having a wall portion, a top, a bottom, and a horizontally extending strengthening rib extending rearwardly from and being monolithic with the wall portion, and located between and spaced from, and located between, the top and bottom, each said horizontally extending rib includes a first horizontal portion extending horizontally away from its respective wall portion and a vertical portion extending from its respective horizontal portion distal from its respective wall portion;

a first support post disposed adjacent said first dasher board section and a second support post disposed adjacent said first dasher board section; and a first mounting member attached to said first support post and at least partially disposed between the vertical portion of the strengthening rib of the first dasher board section and the wall portion of the first dasher board section for restraining movement of the first dasher board section; and a second mounting member attached to said second support post and at least partially disposed between the vertical portion of the strengthening rib of the second dasher board section and the wall portion of the second dasher board section for restraining movement of the second dasher board section.

36. The dasher board section of claim 35, wherein the lengths of the first and second dasher board sections are at least twenty feet.

37. A dasher board system for providing the boundary of a hockey surface, the dasher board system comprising:

a plurality of dasher board sections, said plurality of dasher board sections forming a lower peripheral wall;

supports, said supports being spaced around the peripheral wall on the outside of the dasher board sections, said support being attached to the dasher board sections and restraining movement thereof;

a wire, said wire extending between a plurality of said supports; and transparent upper shielding, said transparent upper shielding extending along and above dasher board sections, said transparent upper shielding being coupled to said wire.

38. The dasher board system of claim 37, wherein said transparent upper shielding includes a row of holes therein, said dasher board system further comprising attachment devices coupling the shielding material to the wire through the holes.

39. The dasher board system of claim 37, further comprising attachment means for coupling the shielding material to the wire.

40. The dasher board system of claim 37, wherein said upper shielding includes a single frameless piece of material in a region above a plurality of the dasher board sections.

41. The dasher board system of claim 37, wherein said upper shielding has a longitudinal portion that is substantially curved along its length at a bottom end between each pair of adjacent supports, and substantially straight along its length at a top end between each pair of adjacent supports.

42. The dasher board system of claim 37, wherein said upper shielding has a longitudinal portion that is substantially curved along its length at a bottom end and at a top end between each pair of adjacent supports.

43. The dasher board system of claim 37, wherein a lower end of the upper shielding is clamped between dasher board sections and supports.

44. The dasher board system of claim 37, wherein said wire is a first wire, said dasher board system further comprising a second wire, said second wire extending between a plurality of said supports, said first wire being coupled to the transparent upper shielding adjacent an upper end thereof and said second wire being coupled to the transparent upper shielding adjacent a lower end thereof.

45. A dasher board system for providing the boundary of a hockey surface, the dasher board system comprising:

a plurality of dasher board sections, said plurality of dasher board sections forming a lower peripheral wall, said plurality of dasher board sections including first, second and third dasher board sections; and transparent upper shielding, said transparent upper shielding extending along and above said first, second, and third dasher board sections, providing an upper peripheral wall, and being a single frameless piece of material in at least the region above said first, second, and third dasher board sections.

46. The dasher board system of claim 45, wherein said transparent shielding consists of polycarbonate material.

47. The dasher board system of claim 45, wherein said transparent upper shielding includes curved portions extending along its length.

48. The dasher board system of claim 45, wherein said transparent shielding consists of transparent material no greater than 0.125 inches thick.

49. A dasher board system for providing the boundary of a hockey surface, the dasher board system comprising:

a first dasher board section;

a second dasher board section, said second dasher board section and said first dasher board being positioned adjacent each other in an end-to-end relationship;

said first dasher board section having a wall portion, a top, a bottom, a length, and a horizontally extending strengthening rib extending rearwardly from the wall portion, said strengthening rib being T-shaped in cross section and located between and spaced from the top and bottom of the first dasher board section, said horizontally extending strengthening rib being monolithic with the wall portion, and extending substantially the entire length of the first dasher board section;

a support post; and a mounting member attached to said support post and said strengthening rib.

* * * * *